US009349311B2

(12) United States Patent
Yu et al.

(10) Patent No.: US 9,349,311 B2
(45) Date of Patent: May 24, 2016

(54) ORGANIC LIGHT EMITTING DISPLAY FOR SENSING ELECTRICAL CHARACTERISTICS OF DRIVING ELEMENT

(71) Applicant: LG DISPLAY CO., LTD., Seoul (KR)

(72) Inventors: Sangho Yu, Paju-si (KR); Bumsik Kim, Suwon-si (KR)

(73) Assignee: LG DISPLAY CO., LTD., Seoul (KR)

( * ) Notice: Subject to any disclaimer, the term of this patent is extended or adjusted under 35 U.S.C. 154(b) by 13 days.

(21) Appl. No.: 14/582,882

(22) Filed: Dec. 24, 2014

(65) Prior Publication Data

US 2015/0379909 A1 Dec. 31, 2015

(30) Foreign Application Priority Data

Jun. 27, 2014 (KR) ..... 10-2014-0080000

(51) Int. Cl.
*G09G 3/32* (2016.01)
*G09G 3/00* (2006.01)

(52) U.S. Cl.
CPC ..... *G09G 3/006* (2013.01); *G09G 3/3258* (2013.01); *G09G 3/3291* (2013.01); *G09G 2300/0828* (2013.01); *G09G 2310/027* (2013.01); *G09G 2320/045* (2013.01); *G09G 2320/0693* (2013.01); *G09G 2330/12* (2013.01)

(58) Field of Classification Search
CPC ..... G09G 3/3275; G09G 3/3283; G09G 2310/0264; G09G 2310/027; G09G 2310/0272; G09G 2310/0275
See application file for complete search history.

(56) References Cited

U.S. PATENT DOCUMENTS

2003/0151570 A1* 8/2003 LeChevalier ..... G09G 3/3216 345/84
2004/0095297 A1* 5/2004 Libsch ..... G09G 3/325 345/76
2007/0139311 A1* 6/2007 Cho ..... G09G 3/3241 345/76
2010/0097360 A1* 4/2010 Cho ..... G09G 3/325 345/205
2012/0081338 A1* 4/2012 Kim ..... G09G 3/3614 345/204

FOREIGN PATENT DOCUMENTS

KR 10-2013-0134256 A 12/2013

* cited by examiner

*Primary Examiner* — Kevin M Nguyen
(74) *Attorney, Agent, or Firm* — Dentons US LLP

(57) ABSTRACT

An organic light emitting display comprises: a display panel with a plurality of pixels connected to data lines and sensing lines, each pixel comprising an OLED and a driving TFT for controlling the amount of light emission of the OLED; and a data driver IC comprising a plurality of sensing units for sensing current data of the pixels through a plurality of sensing channels connected to the sensing lines, each sensing unit comprising: a first current integrator connected to an odd sensing channel; a second current integrator connected to an even sensing channel neighboring the odd sensing channel; and a sample & hold unit that removes common noise components from a first sampled value input from the first current integrator and a second sampled value input from the second current integrator while storing and holding the first and second sampled values.

9 Claims, 19 Drawing Sheets

ORGANIC LIGHT EMITTING DISPLAY FOR SENSING ELECTRICAL CHARACTERISTICS OF DRIVING ELEMENT

This application claims the benefit of Korean Patent Application No. 10-2014-0080000 filed on Jun. 27, 2014, which is incorporated herein by reference for all purposes as if fully forth herein.

BACKGROUND OF THE INVENTION

1. Field of the Invention

This document relates to an organic light emitting display. More particularly, the document relates to an organic light emitting display which is capable of sensing electrical characteristics of a driving element.

2. Discussion of the Related Art

An active matrix-type organic light emitting display comprises a self-emissive organic light emitting diode (hereinafter, referred to as "OLED"), and offers advantages such as fast response speed, high light emission efficiency, high luminance, and wide viewing angle.

An OLED, which is a self-emissive element, comprises an anode, a cathode, and organic compound layers HIL, HTL, EML, ETL, and EIL formed between the anode and the cathode. The organic compound layers comprise a hole injection layer HIL, a hole transport layer HTL, an emission layer EML, an electron transport layer ETL, and an electron injection layer EIL. When a driving voltage is applied to the anode and the cathode, holes passing through the hole transport layer HTL and electrons passing through the electron transport layer ETL move to the emission layer EML to form excitons. As a result, the emission layer EML generates visible light.

In an organic light emitting display, pixels each including an OLED are arranged in a matrix form, and the luminance of the pixels is controlled according to the grayscale of video data. Each pixel comprises a driving element, i.e., driving TFT (thin film transistor), that controls the driving current flowing through the OLED in response to a voltage Vgs applied between its gate electrode and source electrode. Electrical characteristics of the driving TFT, such as threshold voltage, mobility, etc, may be deteriorated with the passage of driving time, causing variations from pixel to pixel. These variations in the electrical characteristics of the driving TFT between the pixels make difference in the luminance of the same video data between the pixels. This makes it difficult to realize a desired image.

An internal compensation method and an external compensation method are known to compensate for variations in electrical characteristics of a driving TFT. In the internal compensation method, variations in the threshold voltage of driving TFTs are automatically compensated for within a pixel circuit. The configuration of the pixel circuit is very complicated because the driving current flowing through the OLED has to be determined regardless of the threshold voltage of the driving TFTs for the sake of internal compensation. Moreover, the internal compensation method is inappropriate to compensate for mobility variations between the driving TFTs.

In the external compensation method, variations in electrical characteristics are compensated for by measuring sensed voltages corresponding to the electrical characteristics (threshold voltage and mobility) of the driving TFTs and modulating video data by an external circuit based on these sensed voltages. In recent years, research on the external compensation method is actively underway.

In the conventional external compensation method, a data driving circuit receives a sensed voltage from each pixel through a sensing line, converts the sensed voltage into a digital sensed value, and then transmits the sensed value to a timing controller. The timing controller modulates digital video data based on the digital sensed value and compensates for variations in electrical characteristics of a driving TFT.

As the driving TFT is a current element, its electrical characteristics are represented by the amount of current Ids flowing between a drain and a source in response to a given gate-source voltage Vgs. By the way, the data driving circuit of the conventional external compensation method senses a voltage corresponding to the current Ids, rather than sensing the current Ids flowing through the driving TFT, in order to sense the electrical characteristics of the driving TFT.

For instance, in the external compensation method disclosed in Korean Patent Nos. 10 2013-0134256, filed Dec. 10, 2013 and 10-2013-0149395, filed Dec. 3, 2013, by the present applicant, LG Display Co., Ltd., the driving TFT is operated in a source follower manner, and then a voltage (driving TFT's source voltage) stored in the line capacitor (parasitic capacitor) of the sensing line is sensed by the data driving circuit. In this external compensation method, the source voltage is sensed when the source electrode potential of the driving TFT DT operating in the source follower manner reaches a saturation state (i.e., the current Ids of the driving TFT DT becomes zero), in order to compensate for variations in the threshold voltage of the driving TFT. Also, in this external compensation method, a linear voltage is sensed before the source electrode potential of the driving TFT DT operating in the source follower manner reaches a saturation state, in order to compensate for variations in the mobility of the driving TFT.

The conventional external compensation method has the following problems.

First, the source voltage is sensed after the current flowing through the driving TFT is changed into the source voltage and stored by using the parasitic capacitor of the sensing line. In this case, the parasitic capacitance of the sensing line is rather large, and moreover the amount of parasitic capacitance may change with the display load of the display panel. Because parasitic capacitance is not kept at a constant level but changes due to a variety of environmental factors, it cannot be calibrated. Any change in the amount of parasitic capacitance where current is stored makes it difficult to obtain an accurate sensed value.

Second, it takes quite a long time to obtain a sensed value, for example, until the source voltage of the driving TFT is saturated, because the conventional external compensation method employs voltage sensing. Especially, if the parasitic capacitance of the sensing line is large, it takes much time to draw enough current to meet a voltage level at which sensing is enabled. This problem becomes more serious in the case of low-grayscale sensing than in the case of high-grayscale sensing, as shown in FIG. 1.

SUMMARY OF THE INVENTION

An aspect of this document is to provide an organic light emitting display which offers shorter sensing time and higher sensing performance when sensing electrical characteristics of a driving element.

An exemplary embodiment of the present invention provides an organic light emitting display comprising: a display panel with a plurality of pixels connected to data lines and sensing lines, each pixel comprising an OLED and a driving TFT for controlling the amount of light emission of the OLED; and a data driver IC comprising a DAC for applying a sensing data voltage to the data lines, a plurality of sensing units for sensing current data of the pixels through a plurality of sensing channels connected to the sensing lines, and an ADC commonly connected to the sensing units, each sensing unit comprising: a first current integrator connected to an odd sensing channel; a second current integrator connected to an even sensing channel neighboring the odd sensing channel; and a sample & hold unit that removes common noise components from a first sampled value input from the first current integrator and a second sampled value input from the second current integrator while storing and holding the first and second sampled values.

The sample & hold unit comprises: a sampling & differential capacitor connected between a first output node of the first current integrator and a second output node of the second current integrator; a first sampling switch connected between the output terminal of the first current integrator and the first output node; a second sampling switch connected between the output terminal of the second current integrator and the second output node; a first holding switch connected between the first output node and the input terminal of the ADC; a second holding switch connected between the second output node and the input terminal of the ADC; a first noise cancelling switch connected between the second output node and a ground power source; and a second noise cancelling switch connected between the first output node and the ground power source.

A sensing operation is performed in two periods comprising: an odd sensing period for sensing pixel currents input from the odd sensing lines and sequentially outputting the same; and an even sensing period for sensing pixel currents input from the even sensing lines and sequentially outputting the same, the pixel currents indicating source-drain currents flowing through the driving TFTs of the pixels, and the sensing data voltage comprises a data voltage for a given grayscale that generates a pixel current greater than 0 and a data voltage for a black gray scale that generates no pixel current, wherein, in the odd sensing period, the data voltage for a given grayscale is applied simultaneously to the pixels connected to the odd sensing lines through the data lines, and the data voltage for a black grayscale is applied simultaneously to the pixels connected to the even sensing lines through the data lines, and in the even sensing period, the data voltage for a given grayscale is applied simultaneously to the pixels connected to the even sensing lines through the data lines, and the data voltage for a black grayscale is applied simultaneously to the pixels connected to the odd sensing lines through the data lines.

In the odd sensing period, the first sampled value contains both pixel current components and the common noise components and the second sampled value contains only the common noise components, and in the even sensing period, the second sampled value contains both pixel current components and the common noise components and the first sampled value contains only the common noise components.

Each of the sensing units further comprises a calibration switching unit for compensating for variations in the ADC's characteristics and variations in the characteristics of the first and second current integrator.

The calibration switching unit comprises: a first biasing switch connected between a node X and an odd sensing channel; a second biasing switch connected between the node X and an even sensing channel; a voltage sourcing switch connected between the node X and the input terminal of a reference voltage; and a current sourcing switch connected between the node X and the input terminal of a reference current.

Each of the sensing units further comprises an equalization switch connected between the input terminal of an equalization voltage and the input terminal of the ADC, wherein the first and second holding switches and the equalization switch are simultaneously turned on for a predetermined period of time during the sensing operation to equalize both ends of the sampling & differential capacitor.

Each of the sensing units further comprises: a first low-pass filter connected between the output terminal of the first current integrator and the first sampling switch; and a second low-pass filter connected between the output terminal of the second current integrator and the second sampling switch.

Each of the sensing units further comprises: a first current conveyor connected between an odd sensing channel; and a first current integrator and a second current conveyor connected between an even sensing channel and a second current integrator.

Each of the first and second current integrator comprises: an amplifier comprising an inverting input terminal connected to any one of the sensing channels, a non-inverting input terminal for receiving a reference voltage, and an output terminal for outputting sampled values; an integration capacitor connected between the inverting input terminal and output terminal of the amplifier; and a first switch connected to both ends of the integration capacitor, each of the first and second integration capacitors comprising: a plurality of capacitors connected in parallel to the inverting input terminal of the amplifier; and a plurality of capacitance adjustment switches connected between the capacitors and the output terminal of the amplifier, wherein the capacitance adjustment switches are turned on/off in response to a switching control signal from based on a digital sensed value output from the ADC.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Hereinafter, exemplary embodiments of the present invention will be described with reference to the accompanying drawings. In the following description, detailed descriptions of related well-known functions or configurations will be omitted if they would obscure the invention with unnecessary detail.

1. Current Sensing Method

A current sensing method on which the present invention is based will be explained.

Figure 1:
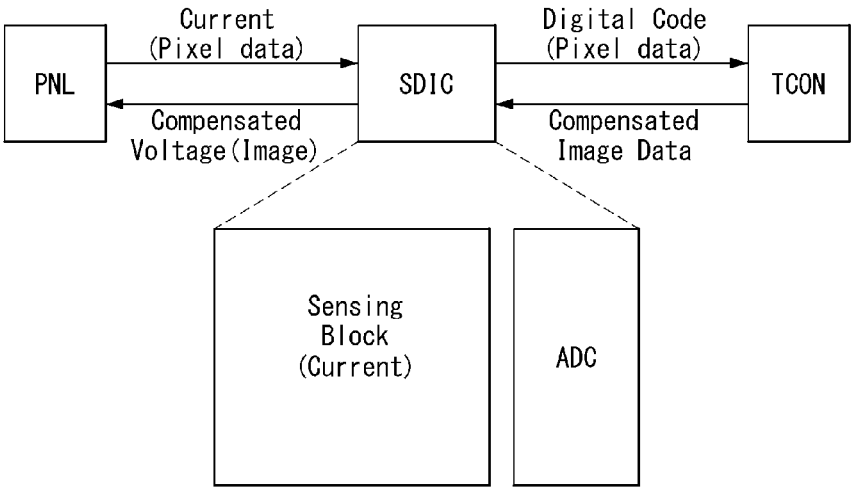
FIG. 1 shows a schematic configuration of an organic light emitting display which implements external compensation based on a current sensing method.
Figure 2:
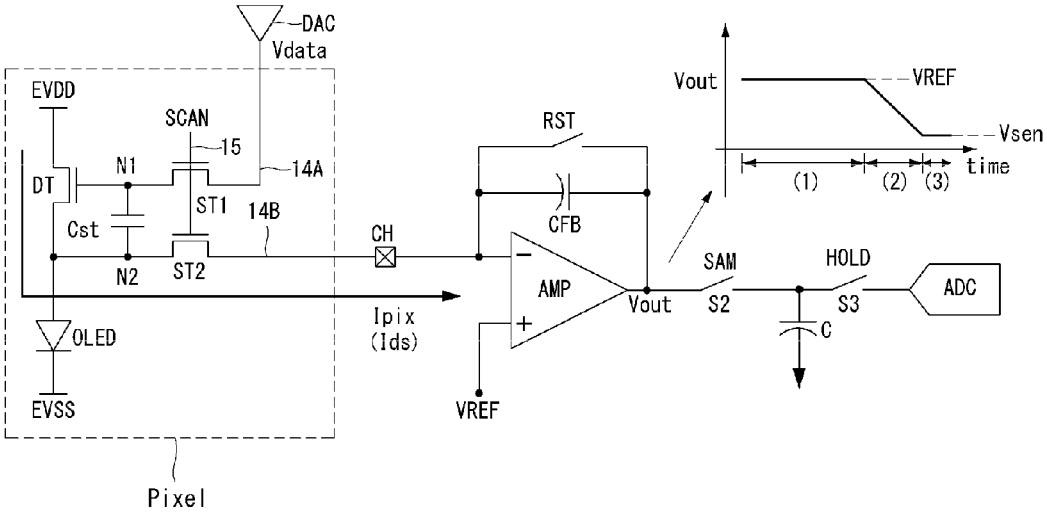
FIG. 2 shows a connection structure between one pixel and a current integrator which is applied to external compensation using the current sensing method.

FIG. 1 shows a schematic configuration of an organic light emitting display which implements external compensation based on a current sensing method. FIG. 2 shows a connection structure between one pixel and a current integrator which is applied to external compensation using the current sensing method.

Referring to FIG. 1, in the present invention, a sensing block and an ADC (analog-to-digital converter), which are required for current sensing, are included in a data driver IC SDIC, and current data is sensed from the pixels of a display panel. The sensing block comprises a plurality of current integrators, and performs an integration of the current data input from the display panel. The pixels of the display panel are connected to sensing lines, and the current integrators are connected to the sensing lines via sensing channels. An integrated value (represented by a voltage) obtained from each integrator is sampled and held and input into the ADC. The ADC converts an analog integrated value into a digital sensed value, and then transmits it to a timing controller. The timing controller derives compensation data for compensating for threshold voltage variation and a mobility variation based on the digital sensed value, modulates image data for image display based on the compensation data and then transmits it to the data driver IC SDIC. The modulated image data is converted into a data voltage for image display by the data driver IC SDIC and then applied to the display panel.

FIG. 2 depicts a connection structure between one pixel and a current integrator which is applied to external compensation using the current sensing method. Referring to FIG. 2, a pixel PIX of the present invention may comprise an OLED, a driving TFT (thin film transistor) DT, a storage capacitor Cst, a first switching TFT ST1, and a second switching TFT ST2.

The OLED comprises an anode connected to a second node N2, a cathode connected to the input terminal of a low-potential driving voltage EVSS, and an organic compound layer located between the anode and the cathode. The driving TFT DT controls the amount of current going into the OLED according to a gate-source voltage Vgs. The driving TFT DT comprises a gate electrode connected to a first node N1, a drain electrode connected to the input terminal of a high-potential driving voltage EVDD, and a source electrode connected to the second node N2. The storage capacitor Cst is connected between the first node N1 and the second node N2. The first switching TFT ST1 applies a data voltage Vdata on a data voltage supply line 14A to the first node N1 in response to a gate pulse SCAN. The first switching TFT ST1 comprises a gate electrode connected to a gate line 15, a drain electrode connected to the data voltage supply line 14A, and a source electrode connected to the first node N1. The second switching TFT ST2 switches the flow of current between the second node N2 and a sensing line 14B in response to a gate pulse SCAN. The second switching TFT ST2 comprises a gate electrode connected to a second gate line 15D, a drain electrode connected to the sensing line 14B, and a source electrode connected to the second node N2.

As shown in FIG. 2, a current integrator CI comprises an amplifier AMP comprising an inverting input terminal (−) connected to the sensing line 14B via a sensing channel CH and receiving a pixel current Ipix, i.e., the source-drain current Ids of the driving TFT, from the sensing line 14B, a non-inverting input terminal (+) for receiving a reference voltage VREF, and an output terminal, an integration capacitor CFB connected between the inverting input terminal (−) and output terminal of the amplifier AMP, and a reset switch RST connected to both ends of the integration capacitor CFB.

The current integrator CI is connected to the ADC through a sample & hold circuit. The sample & hold circuit comprises a sampling switch SAM for sampling the output Vout of the amplifier AMP, a sampling capacitor C storing the output Vout applied through the sampling switch SAM, and a holding switch HOLD for sending the output Vout stored in the sampling capacitor C.

A sensing operation for obtaining an integrated value Vsen from the current integrator CI is performed in several periods including an initialization period (1), a sensing period (2), and a sampling period (3).

In the initialization period (1), the amplifier AMP operates as a unit gain buffer with a gain of 1 by the turn-on of the reset switch RST. In the initialization period (1), the input terminals (+,−) and output terminal of the amplifier AMP, the sensing line 14B, and the second node N2 are all initialized to the reference voltage VREF.

During the initialization period (1), a sensing data voltage Vdata-SEN is applied to the first node N1 through the DAC of the data driver IC SDIC. Accordingly, a source-drain current Ids corresponding to a potential difference {(Vdata-SEN)-VREF} between the first node N1 and the second node N2 is stabilized as it flows to the driving TFT DT. However, since the amplifier AMP continues to act as the unit gain buffer during the initialization period, the potential of the output terminal is maintained at the reference voltage VREF.

In the sensing period (2), the amplifier AMP operates as the current integrator CI by the turn-off of the reset switch RST to perform an integration of the source-drain current Ids flowing through the driving TFT DT by using the integration capacitor CFB. In the sensing period Tsen, the potential difference between both ends of the integration capacitor CFB increases due to the current Ids entering the inverting input terminal (−) of the amplifier AMP as the sensing time passes, i.e., the value of stored current Ids increases. However, the inverting input terminal (−) and the non-inverting input terminal (+) are shorted through a virtual ground due to the nature of the amplifier AMP, and the potential difference between the inverting input terminal (−) and the non-inverting input terminal (+) is zero. Therefore, the potential of the inverting input terminal (−) is maintained at the reference voltage VREF in the sensing period (2), regardless of whether the potential difference across the integration capacitor CFB has increased or not. Instead, the output terminal potential of the amplifier AMP decreases in response to the potential difference between both ends of the integration capacitor CFB. Based on this principle, the current Ids entering through the sensing line 14B in the sensing period (2) is converted to an integrated value Vsen, which is a voltage value, through the integration capacitor CFB. The falling slope of an output Vout of the current integrator CI increases as the amount of current Ids entering through the sensing line 14B becomes larger. Therefore, the larger the amount of current Ids, the smaller the integrated value Vsen. In the sensing period (2), the integrated value Vsen passes through the sampling switch SAM and is stored in the sampling capacitor C.

In the sampling period (3), when the holding switch HOLD is turned on, the integrated value Vsen stored in the sampling capacitor C passes through the holding switch HOLD and is input into the ADC. The integrated value Vsen is converted into a digital sensed value by the ADC and then transmitted to the timing controller. The timing controller applies the digital sensed value to a compensation algorithm to derive a threshold voltage variation ΔVth and a mobility variation ΔK and compensation data for compensating for these variations. The compensation algorithm may be implemented as a look-up table or a calculational logic.

The capacitance of the integration capacitor CFB included in the current integrator CI of this invention is only one-several hundredths of the parasitic capacitance existing across the sensing line. Thus, the current sensing method of this invention can drastically reduce the time taken to draw enough current Ids to meet the integrated value Vsen with which sensing is enabled, as compared to a conventional voltage sensing method. Moreover, in the conventional voltage sensing method, it takes quite a long time to sense a threshold voltage because the source voltage of the driving TFT is sampled as a sensed voltage after it is saturated; whereas, in the current sensing method, it takes much less time to sense a threshold voltage and mobility because an integration of the source-drain current of the driving TFT and sampling of the integration value can be performed within a short time by means of current sensing.

Also, the integration capacitor CFB included in the current integrator CI of this invention is able to obtain an accurate sensed value because its stored values do not change with display load but can be easily calibrated, unlike the parasitic capacitor of the sensing line.

As such, the present invention can greatly reduce sensing time by implementing low current sensing and high-speed sensing by a current sensing method using a current integrator.

2. Drawbacks of Current Sensing Method

Figure 3:
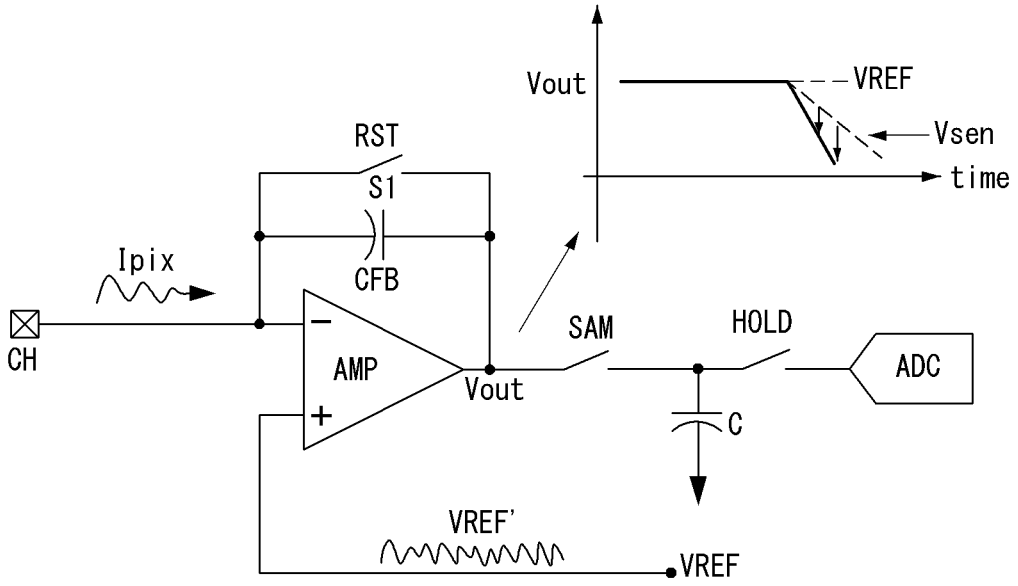
FIG. 3 shows the drawbacks of the current sensing method, which is susceptible to noise.

FIG. 3 shows the drawbacks of the current sensing method, which is susceptible to noise.

As stated above, the current sensing method using a current integrator is advantageous when reducing sensing time, compared to the conventional voltage sensing methods, but has the drawback of being susceptible to noise because the pixel current Ipix (source-drain current Ids of the driving TFT) to be sensed is usually very small. Noise may enter the current integrator due to variations in the reference voltage VREF applied to the non-inverting input terminal (+) of the current integrator and different sources of noise between the sensing lines, each connected to the inverting input terminal (−) of the current integrator. Such noise is amplified within the current integrator and applied to the integrated value Vsen, thus causing distortion in the sensing result. Moreover, it is difficult to accurately sense the actual pixel current Ipix since, using the current sensing method, leakage current components in the corresponding channel cannot be applied to the integrated value from the current integrator.

Such a decrease in sensing performance leads to lower compensation performance because electrical characteristics of the driving TFT cannot be compensated as much as desired.

An improved current sensing method capable of offering higher sensing performance will be discussed below.

Figure 4:
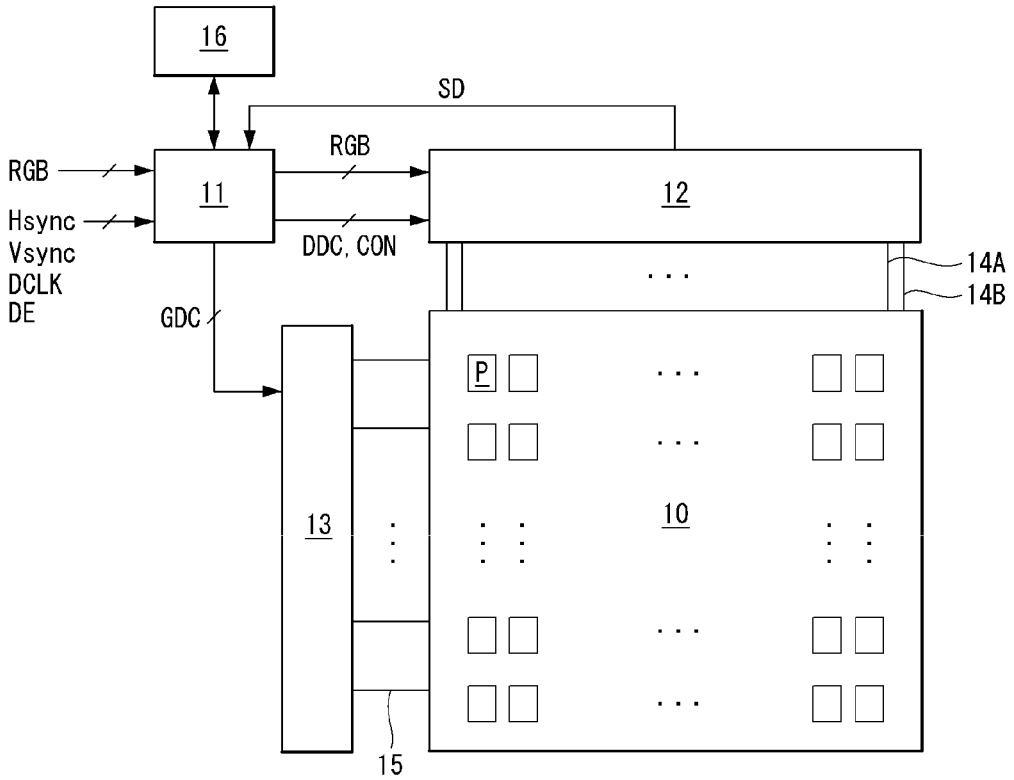
FIG. 4 shows an organic light emitting display according to an exemplary embodiment of the present invention to which an improved current sensing method is applied.
Figure 5:
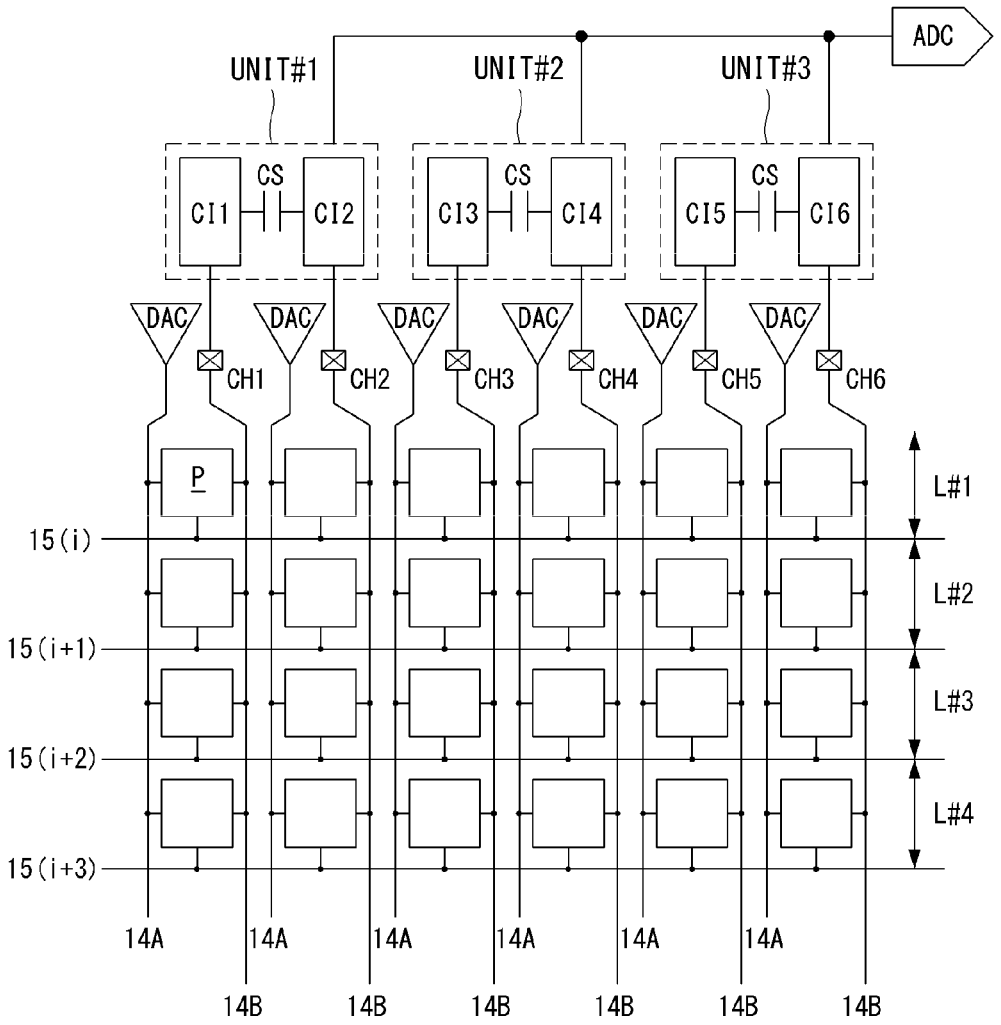
FIG. 5 shows the configuration of a pixel formed on the display panel of FIG. 4 and the configuration of a data driver IC for implement the improved current sensing method.

3. Improved Current Sensing Method According to the Present Invention and Embodiments Using the Same FIG. 4 shows an organic light emitting display according to an exemplary embodiment of the present invention to which an improved current sensing method is applied. FIG. 5 shows the configuration of a pixel formed on the display panel of FIG. 4 and the configuration of a data driver IC for implement the improved current sensing method.

Referring to FIGS. 4 and 5, the organic light emitting display according to the exemplary embodiment of the present invention comprises a display panel 10, a timing controller 11, a data driving circuit 12, a gate driving circuit 13, and a memory 16.

A plurality of data lines 14A and sensing lines 14B and a plurality of gate lines 15 cross over each other on the display panel 10, and pixels P are arranged in a matrix formed at their crossings.

Each pixel P is connected to any one of the data lines 14A, any one of the sensing lines 14B, and any one of the gate lines 15. Each pixel P is electrically connected to a data voltage supply line 14A to receive a data voltage from the data voltage supply line 14A and output a sensing signal through a sensing line 14B, in response to a gate pulse input through a gate line 15.

Each pixel P receives a high-potential driving voltage EVDD and a low-potential driving voltage EVSS from a power generator (not shown). A pixel P of this invention may comprise an OLED, a driving TFT, first and second switching TFTs, and a storage capacitor, for the sake of external compensation. The TFTs constituting the pixel P may be implemented as p-type or n-type. Also, a semiconductor layer of the TFTs constituting the pixel P may comprise amorphous silicon, polysilicon, or oxide.

Each pixel P may operate differently in a normal driving operation for displaying an image and in a sensing operation for obtaining a sensed value. Sensing may be performed for a predetermined period of time before normal driving or for vertical blank periods during normal driving.

Normal driving may occur when the data driving circuit 12 and the gate driving circuit 13 operate normally under the control of the timing controller 11. Sensing may occur when the data driving circuit 12 and the gate driving circuit 13 perform a sensing operation under the control of the timing controller 11. An operation of deriving compensation data for variation compensation based on a sensing result and an operation of modulating digital video data using compensation data are carried out by the timing controller 11.

The data driving circuit 12 comprises at least one data driver IC (integrated circuit) SDIC. The data driver IC SDIC comprises a plurality of digital-to-analog converters (hereinafter, DACs) connected to each data line 14A, a plurality of sensing units UNIT#1 to UNIT#m connected to each sensing line 14B, and an ADC connected commonly to the output terminals of the sensing units UNIT#1 to UNIT#m+.

In a normal driving operation, the DAC of the data driver IC SDIC converts digital video data RGB into an image display data voltage and supplies it to the data lines 14A, in response to a data timing control signal DDC applied from the timing controller 11. On the other hand, in a sensing operation, the DAC of the data driver IC SDIC generates a sensing data voltage and supplies it to the data lines 14A, in response to a data timing control signal DDC applied from the timing controller 11. The sensing data voltage comprises a data voltage for a given grayscale that generates a pixel current (the source-drain current Ids of the driving TFT) greater than 0 and a data voltage for a black gray scale that suppresses the generation of the pixel current. In the sensing operation, the data driver IC SDIC alternately supplies the data voltage for the given gray scale and the data voltage for the black grayscale to the data lines 14A under the control of the timing controller 11 so that the data voltage for the given gray scale and the data voltage for the black grayscale are supplied in opposite directions to each other to pixels connected to even sensing channels and pixels connected to odd sensing channels. That is, if the data voltage for the given grayscale is supplied to the pixels connected to the even sensing channels, the data voltage for the black grayscale is applied to the pixels connected to the odd sensing channels, and contrariwise, if the data voltage for the black gray scale is supplied to the pixels connected to the even sensing channels, the data voltage for the given grayscale is applied to the pixels connected to the even sensing channels.

Each sensing unit UNIT#1 to UNIT#m of the data driver IC SDIC comprises a first current integrator CI1 connected to any one of odd sensing channels CH1, 3, 5, . . . , a second current integrator CI2 connected to any one of even sensing channels CH2, 4, 6, . . . , and a sampling & differential capacitor CS connected between the output terminal of the current integrator CI and the output terminal of the second current integrator CI. The odd sensing channel to which the first current integrator CI1 is connected and the even sensing channel to which the second current integrator CI2 is connected may neighbor each other. The sampling & differential capacitor CS stores a first sampled value from the first current integrator CI1 and a second sampled value from the second current integrator CI2, and removes common noise components from the first and second sampled values by noise cancellation.

The ADC of the data driver IC SDIC sequentially digitizes the output of the sensing units UNIT#1 to UNIT#m and transmits it to the timing controller 11.

In the normal driving operation, the gate driving circuit 13 generates an image display gate pulse based on a gate control signal GDC and then sequentially supplies it to the gate lines 15 in a line sequential manner L#1, L#2, . . . . In the sensing operation, the gate driving circuit 13 generates a sensing gate pulse based on the gate control signal GDC and then sequentially supplies it to the gate lines 15 in a line sequential manner L#1, L#2, . . . . The sensing gate pulse may have a larger ON pulse region than the image display gate pulse. The ON pulse region of the sensing gate pulse corresponds to one line sensing ON time. Here, one line sensing ON time denotes the scan time taken to simultaneously sense the pixels of one pixel line L#1, L#2, . . . .

The timing controller 11 generates a data control signal DDC for controlling the operation timing of the data driving circuit 12 and a gate control signal GDC for controlling the operation timing of the gate driving circuit 13, based on timing signals such as a vertical synchronization signal Vsync, a horizontal synchronization signal Hsync, a dot clock signal DCLK, and a data enable signal DE. The timing controller 11 identifies normal driving and sensing based on a predetermined reference signal (driving power enable signal, vertical synchronization signal, data enable signal, etc), and generates the data control signal DDC and the gate control signal GDC depending on each driving operation. The sensing operation involves the ADC calibration mode (see FIGS. 8 to 10) for compensating for variations in the ADC's characteristics, the CI calibration mode (see FIGS. 11 to 13) for compensating for variations in the current integrator's characteristics, and the sensing mode (see FIGS. 14 to 16) for sensing pixel current data. In the sensing operation, the timing controller 11 may control the driving modes in a predetermined sequence, and also may control the operations of the sensing units UNIT#1 to UNIT#m according to each driving mode. To this end, the timing controller 11 may generate a control signal CON for each driving mode and control the switching timing of internal switches (RST, CVCE, CVCO, SIO_VREF, SIO_CREF, SAM_E, SAM_O, HOLD_E, HOLD_O, HOLD_EG, HOLD_OG, EQ, etc. of FIG. 7) of the sensing units UNIT#1 to UNIT#m.

In the sensing operation, the timing controller 11 may transmit digital data corresponding to a sensing data voltage to the data driving circuit 12. The digital data comprises first digital data corresponding to the data voltage for the given grayscale and second digital data corresponding to the data voltage for the black grayscale. In the sensing operation, the timing controller 11 applies a digital sensed value SD transmitted from the data driving circuit 12 to a pre-stored compensation algorithm to derive a threshold voltage variation ΔVth and a mobility variation ΔK, and then stores compensation data in a memory 16 to compensate for these variations.

In the normal driving operation, the timing controller 11 modulates digital video data RGB for image display with reference to the compensation data stored in the memory 16 and then transmits it to the data driving circuit 12.

Figure 6:
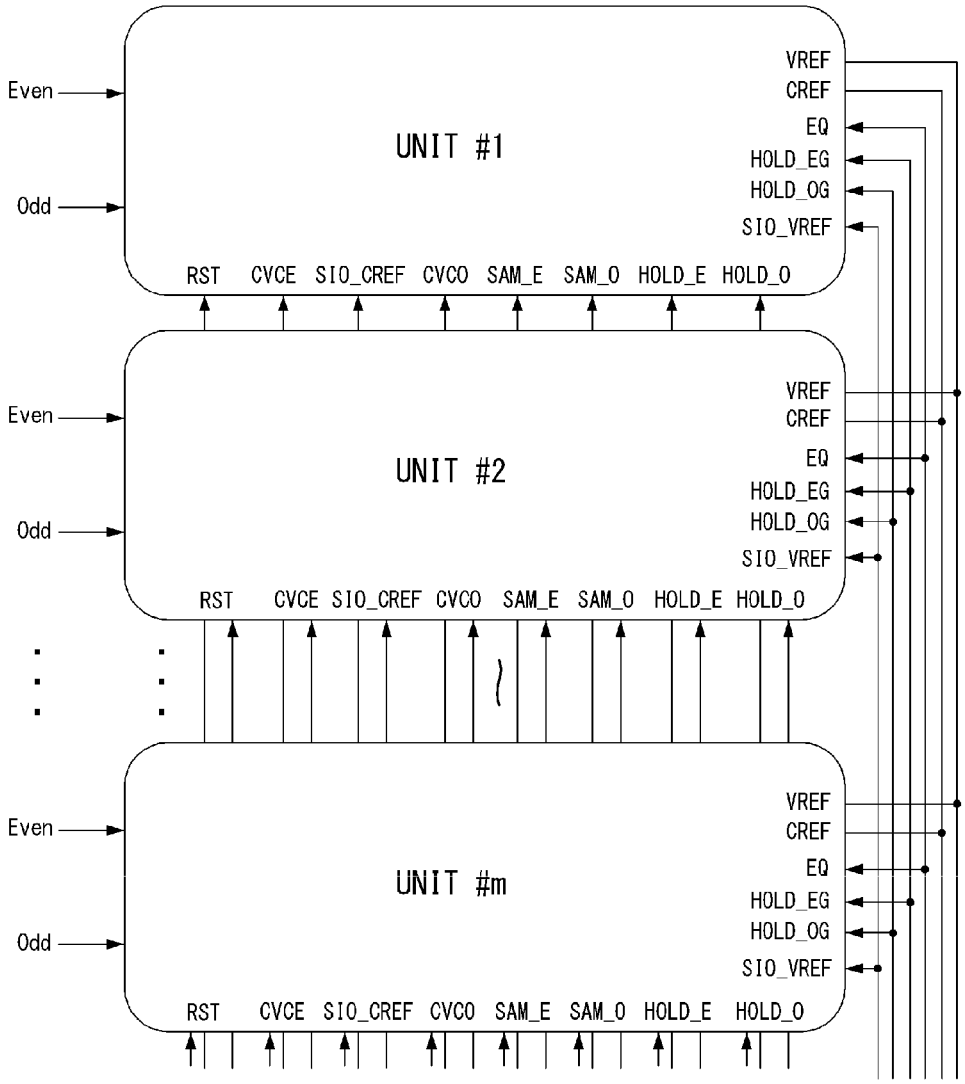
FIG. 6 shows driving signals applied to sensing units.
Figure 7:
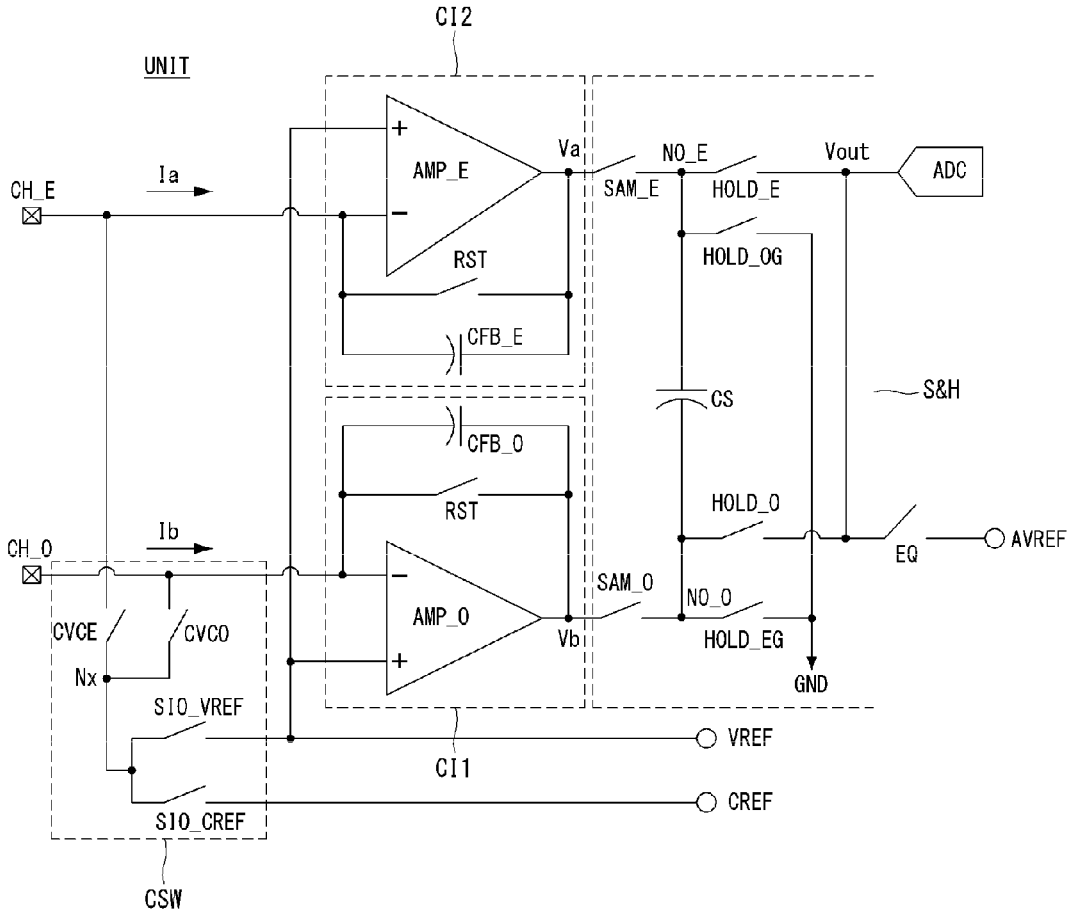
FIG. 7 shows a detailed configuration of a sensing unit.

FIG. 6 shows driving signals applied to sensing units UNIT#1 to UNIT#m. FIG. 7 shows a detailed configuration of a sensing unit UNIT. For convenience, the driving signals of FIG. 6 are denoted by the same reference characters as the switches shown in FIG. 7. For instance, the driving signal EQ of FIG. 6 is a control signal for switching the switch EQ shown in FIG. 7.

Referring to FIGS. 6 and 7, each of the sensing units UNIT#1 to UNIT#m comprises a first current integrator CI1 connected to an odd sensing channel CH_O, a second current integrator CI2 connected to an even sensing channel CH_E neighboring the odd sensing channel CH_O, and a sample & hold unit S&H that obtains an analog integrated value, which equals the difference between the sampled values input from the first and second current integrators CI1 and CI2 and from which common noise components are removed, and supplies it as an output Vout to the ADC.

The first current integrator CI1 comprises a first amplifier AMP_O comprising an inverting input terminal (−) connected to an odd-numbered one of the sensing lines 14B via an odd sensing channel CH_O and receiving a first pixel current Ipix (Ib), i.e., the source-drain current of the driving TFT, from the odd sensing line, a non-inverting input terminal (+) receiving a reference voltage VREF, and an output terminal, a first integration capacitor CFB_O connected between the inverting input terminal (−) and output terminal of the first amplifier AMP_O, and a reset switch RST connected to both ends of the first integration capacitor CFB_O. The first current integrator CI1 performs an integration of the first pixel current Ipix (Ib) to output a first sampled value Vb.

The second current integrator CI2 comprises a second amplifier AMP_E comprising an inverting input terminal (−) connected to an even-numbered one of the sensing lines 14B via an even sensing channel CH_E and receiving a second pixel current Ipix (Ia) from the odd sensing line, a non-inverting input terminal (+) receiving a reference voltage VREF, and an output terminal, a second integration capacitor CFB_E connected between the inverting input terminal (−) and output terminal of the second amplifier AMP_E, and a reset switch RST connected to both ends of the second integration capacitor CFB_E. The second current integrator CI2 performs an integration of the second pixel current Ipix (Ia) to output a second sampled value Va.

The sample & hold unit S&H increases sensing accuracy by removing common noise components (including leakage current components) from the first and second sampled values Vb and Va by noise cancellation so that only the pixel current component is included in the output Vout sent to the ADC, while storing and holding the first sampled value Vb input form the first current integrator CI1 and the second sampled value Va input from the second current integrator CI2.

To this end, the sample & hold unit S&H comprises a sampling & differential capacitor CS connected between a first output node NO_O of the first current integrator CI1 and a second output node NO_E of the second current integrator CI2, a first sampling switch SAM_O connected between the output terminal of the first current integrator CI1 and the first output node NO_O, a second sampling switch SAM_E connected between the output terminal of the second current integrator CI2 and the second output node NO_E, a first holding switch HOLD_O connected between the first output node NO_O and the input terminal of the ADC, a second holding switch HOLD_E connected between the second output node NO_E and the input terminal of the ADC, a first noise cancelling switch HOLD_OG connected between the second output node NO_E and a ground power source GND, and a second noise cancelling switch HOLD_EG connected between the first output node NO_O and the ground power source GND.

The sampling & differential capacitor CS stores the first and second sampled values Vb and Va at its two ends by a switching operation of the first and second sampling switches SAM_O and SAM_E. The first noise cancelling switch HOLD_OG connects the second output node NO_E with the ground power source GND to remove common noise components from the first and second sampled values Vb and Va, and the second noise cancelling switch HOLD_EG connects the first output node NO_O with the ground power source GND to remove common noise components from the first and second sampled values Vb and Va. The first holding switch HOLD_O supplies the voltage of the first output node NO_O, from which the common noise components are removed, as the output Vout to the ADC, and the second holding switch HOLD_E supplies the voltage of the second output node NO_E, from which the common noise components are removed, as the output Vout to the ADC.

The ADC converts the output Vout, from which the common noise components are removed, into a digital sensed value. As the digital sensed value is not affected by noise, it reflects the actual pixel current as accurately as possible. Accordingly, the present invention can greatly increase sensing accuracy (sensing performance) and moreover can greatly improve compensation performance during a compensation operation based on a sensing result.

Each of the sensing units UNIT#1 to UNIT#m may further comprise a calibration switching unit CSW for compensating for variations in the ADC's characteristics and variations in the characteristics of the first and second current integrator CI1 and C12.

The calibration switching unit CSW comprises a first biasing switch CVCO connected between a node X Nx and an odd sensing channel CH_O, a second biasing switch CVCE connected between the node X Nx and an even sensing channel CH_E, a voltage sourcing switch SIO_VREF connected between the node X Nx and the input terminal of a reference voltage VREF, and a current sourcing switch SIO_CREF connected between the node X Nx and the input terminal of a reference current CREF.

The voltage sourcing switch SIO_VREF is turned on in the ADC calibration mode (see FIGS. 8 to 10) for compensating for variations in the ADC's characteristics. The current source switch SIO_CREF is turned on in the CI calibration mode (see FIGS. 11 to 13) for compensating for variations in the characteristics of the first and second current integrators CI1 and CI2. In the CI calibration mode, the first biasing switch CVCO and the second biasing switch CVCE may be alternately turned on.

In the ADC/CI calibration mode, each of the sensing units UNIT#1 to UNIT#m performs a calibration operation by the reference voltage VREF or reference current CREF input through the calibration switching unit CSW. The present invention can further increase sensing performance and compensation performance because offset and gain errors in the ADC and offset and gain errors in the amplifier included in an integrator can be additionally compensated for by a calibration operation using the calibration switching unit CSW.

Each of the sensing units UNIT#1 to UNIT#m may further comprise an equalization switch EQ connected between the input terminal of an equalization voltage AVREF and the input terminal of the ADC. The first and second holding switches HOLD_O and HOLD_E and the equalization switch EQ are simultaneously turned on for a predetermined period of time during the sensing operation to equalize both ends of the sampling & differential capacitor CS, thereby further increasing sensing performance and compensation performance.

ADC Calibration Mode

Figure 8:
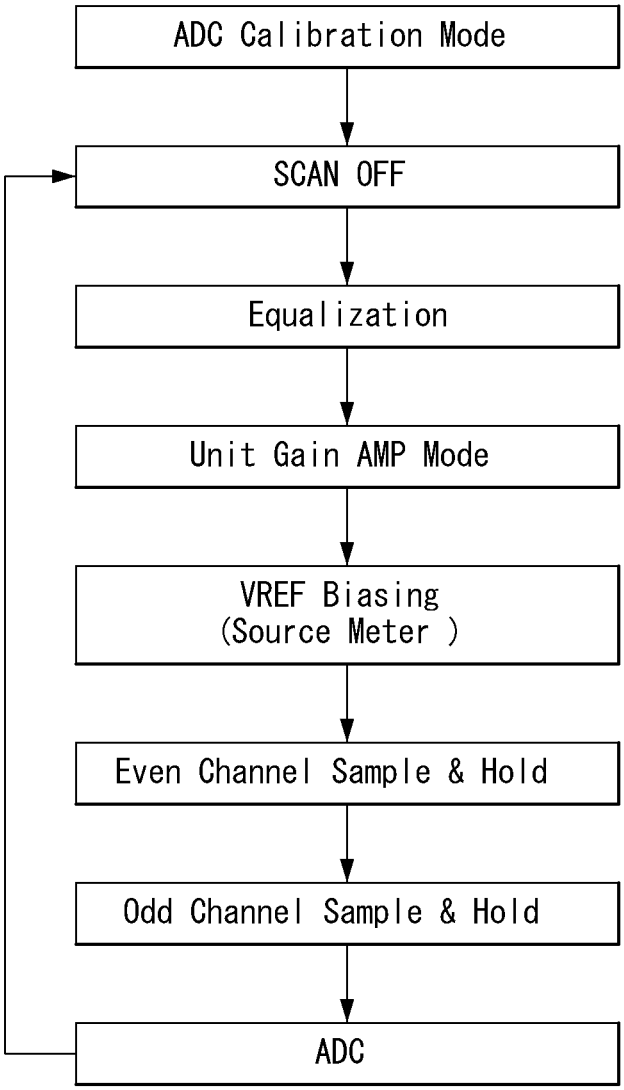
FIG. 8 schematically shows the operational sequence of the ADC calibration mode.
Figure 9:
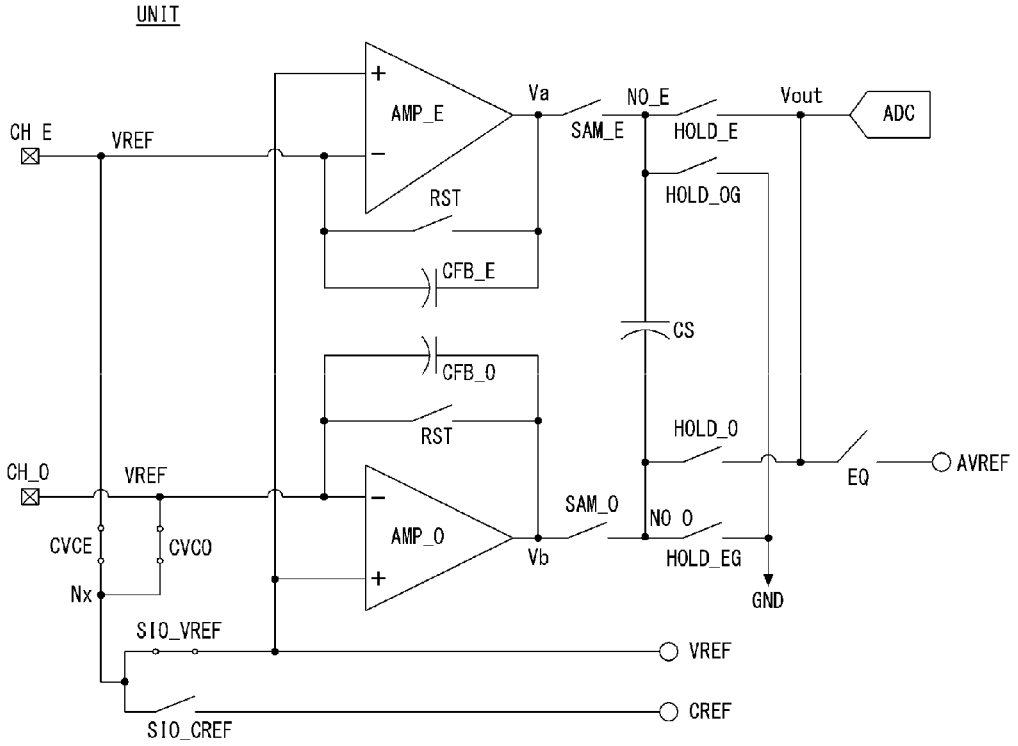
FIGS. 9 and 10 show an operating state of a sensing unit in the ADC calibration mode.
Figure 10:
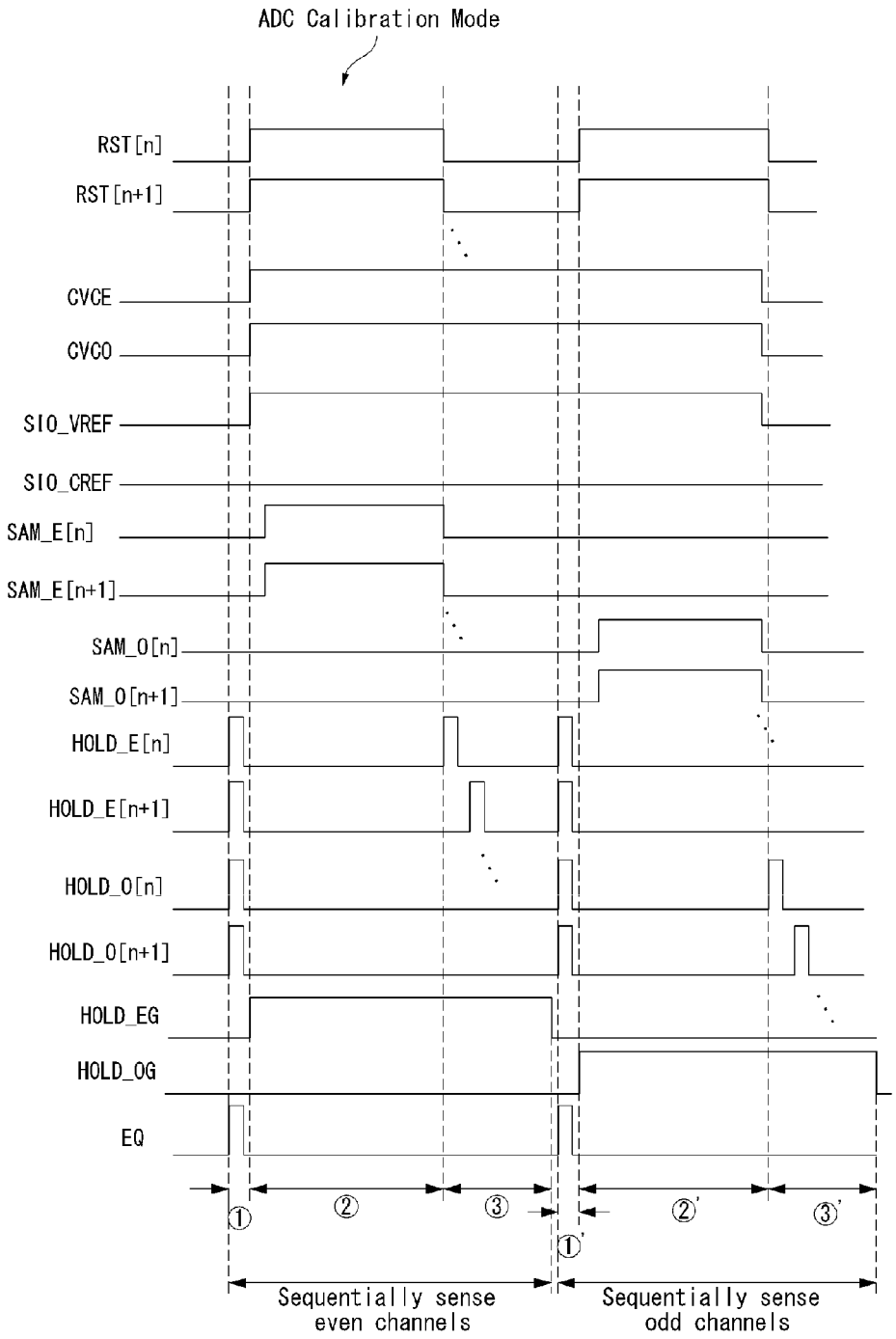

FIG. 8 schematically shows the operational sequence of the ADC calibration mode. FIGS. 9 and 10 show an operating state of a sensing unit in the ADC calibration mode.

Referring to FIGS. 8 to 10, the ADC calibration mode is performed without the display panel being driven. In the ADC calibration mode, even sensing channels may be sensed firstly and then odd sensing channels may be sensed secondly, or vice versa. In FIG. 10, [n] indicates an nth sensing unit UNIT#n, and [n+1] indicates an (n+1)th sensing unit UNIT#n+1.

In the first sensing operation, the first and second holding switches HOLD_O and HOLD_E and equalization switches EQ of the sensing units UNIT#1 to UNIT#m are simultaneously turned on to equalize both ends of the sampling & differential capacitor CS (① of FIG. 10). Subsequently, in the first sensing operation, the reset switches RST of the sensing units UNIT#1 to UNIT#m are simultaneously turned on to allow the current integrators of the sensing units UNIT#1 to UNIT#m to all operate as unit gain buffers and simultaneously bias the reference voltage VREF to the sensing units UNIT#1 to UNIT#m. Of the outputs of the first and second current integrators of the sensing units UNIT#1 to UNIT#m, the outputs of the second current integrators corresponding to the even sensing channels are simultaneously sampled and stored in the sampling & differential capacitors CS of the sensing units UNIT#1 to UNIT#m (② of FIG. 10). Next, in the first sensing operation, the second holding switches are sequentially turned on to sequentially supply the outputs of the second current integrators stored in the sampling & differential capacitors CS to the ADC (③ of FIG. 10).

In the second sensing operation, the first and second holding switches HOLD_O and HOLD_E and equalization switches EQ of the sensing units UNIT#1 to UNIT#m are simultaneously turned on to equalize both ends of the sampling & differential capacitor CS (①' of FIG. 10). Subsequently, in the secibd sensing operation, the reset switches RST of the sensing units UNIT#1 to UNIT#m are simultaneously turned on to allow the current integrators of the sensing units UNIT#1 to UNIT#m to all operate as unit gain buffers and simultaneously bias the reference voltage VREF to the sensing units UNIT#1 to UNIT#m. Of the outputs of the first and second current integrators of the sensing units UNIT#1 to UNIT#m, the outputs of the second current integrators corresponding to the odd sensing channels are simultaneously sampled and stored in the sampling & differential capacitors CS of the sensing units UNIT#1 to UNIT#m (②' of FIG. 10). Next, in the second sensing operation, the second holding switches are sequentially turned on to sequentially supply the outputs of the second current integrators stored in the sampling & differential capacitors CS to the ADC (③' of FIG. 10).

The output level of the sensing units UNIT#1 to UNIT#m applied to the ADC differs according to the reference voltage VREF or equalization voltage AVREF. In the present invention, offset errors and/or gain errors in the ADC can be compensated for by performing ADC calibration while sweeping the reference voltage VREF or equalization voltage AVREF.

CI Calibration Mode

Figure 11:
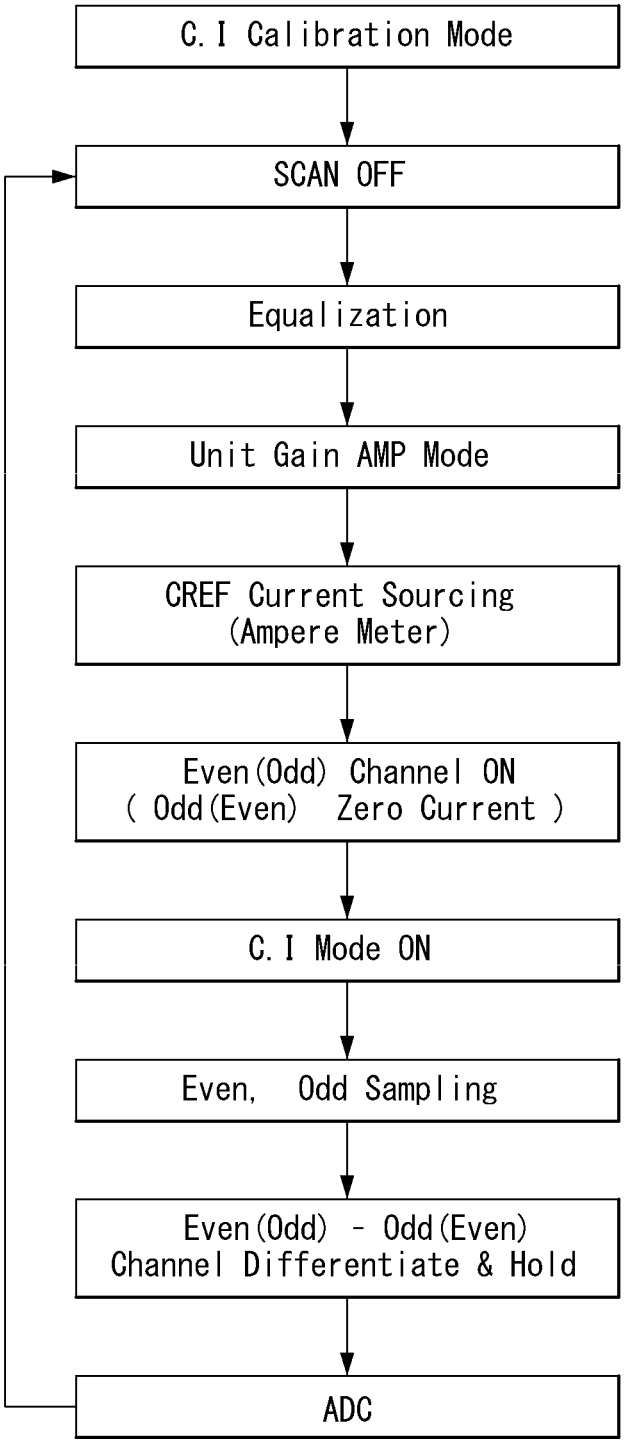
FIG. 11 schematically shows the operational sequence of the CI calibration mode.
Figure 12:
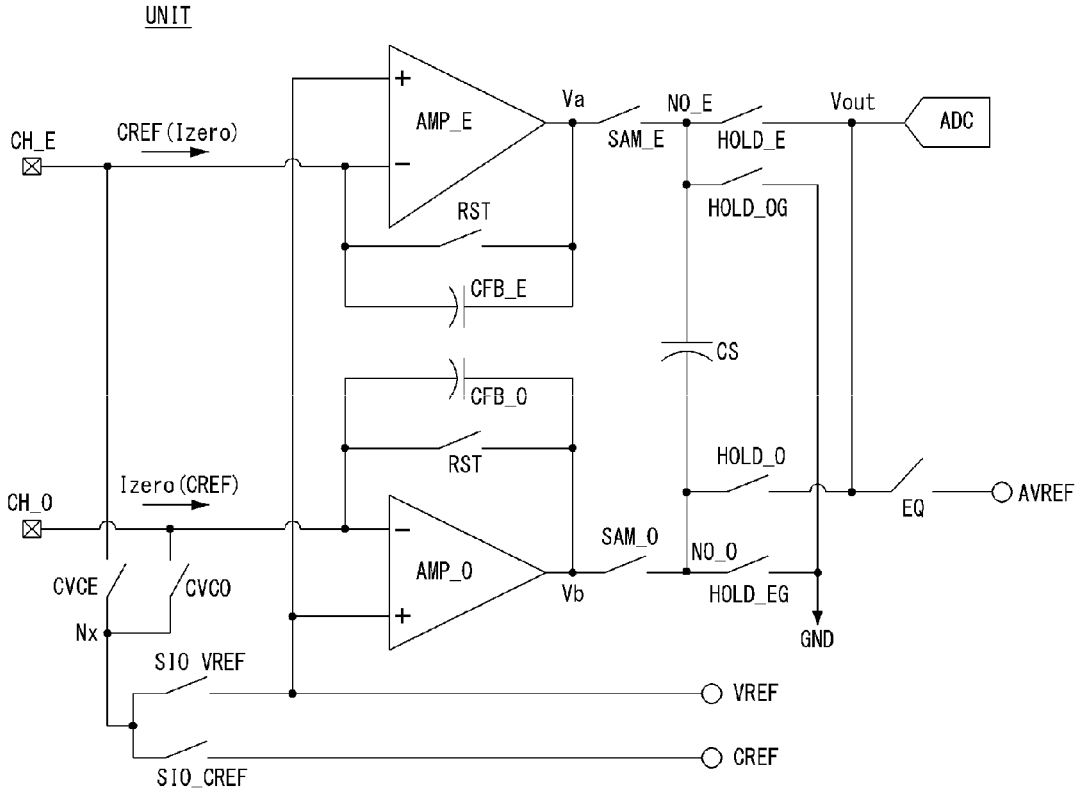
FIGS. 12 and 13 show an operating state of a sensing unit in the CI calibration mode.
Figure 13:
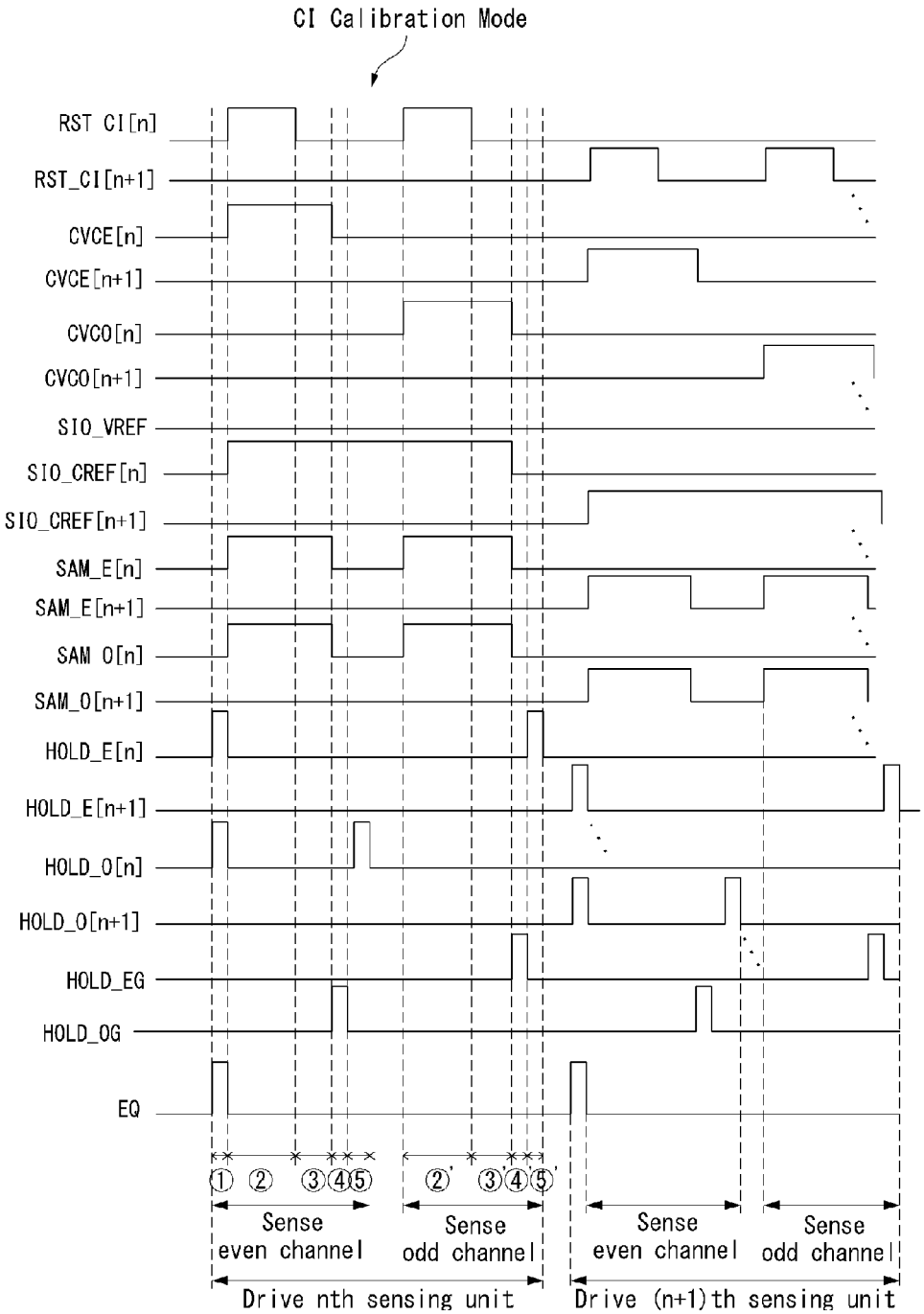

FIG. 11 schematically shows the operational sequence of the CI calibration mode. FIGS. 12 and 13 show an operating state of a sensing unit in the CI calibration mode.

Referring to FIGS. 11 to 13, the CI calibration mode is performed without the display panel being driven. The sensing units UNIT#1 to UNIT#m are commonly connected to the input terminal of the reference current CREF. Accordingly, in the CI calibration mode, each sensing unit may sequentially perform sensing so that the reference current CREF is applied to each sensing unit one hundred percent. Each sensing unit may perform first sensing on an even sensing channel and then second sensing on an odd sensing channel, or vice versa. In FIG. 13, [n] indicates an nth sensing unit UNIT#n, and [n+1] indicates an (n+1)th sensing unit UNIT#n+1.

First and second sensing operations of the nth sensing unit UNIT#n will be described below.

In the first sensing operation, the first and second holding switches HOLD_O and HOLD_E and equalization switch EQ of the sensing units UNIT#n are simultaneously turned on to equalize both ends of the sampling & differential capacitor CS (① of FIG. 13). Subsequently, in the first sensing operation, the reset switch RST of the sensing unit UNIT#n is simultaneously turned on to allow the current integrators of the sensing unit UNIT#n to operate as a unit gain buffer and bias the reference current CREF with noise components to the even sensing channel CH_E of the sensing unit UNIT#n. Since the reference current CREF is not applied to the odd sensing channel CH_O of the sensing unit UNIT#n, a zero current Izero—which is much lower than the reference current—caused by the noise components flows to the odd sensing channel CH_O of the sensing unit UNIT#n (② of FIG. 13). Next, in the first sensing operation, the reset switch RST of the sensing unit UNIT#n is turned off to allow the current integrators of the sensing unit UNIT#n in an integration mode. In the integration mode, the output of the second current integrator connected to the even sensing channel CH_E is stored as a second sampled value Va at one node NO_E of the sampling & differential capacitor CS, and the output of the first current integrator connected to the odd sensing channel CH_O is stored as a first sampled value Vb at the other node NO_O of the sampling & differential capacitor CS (③ of FIG. 13). Next, in the first sensing operation, the first noise cancelling switch HOLD_OG is turned on to connect the node NO_E of the sampling & differential capacitor CS to the ground power source and remove common noise components from the first and second sampled values Vb and Va. As explained through FIG. 2, integrated values output from the current integrators are inversely proportional to the amount of input current. Thus, the first sampled value Vb corresponding to the zero current Izero is larger than the second sampled value Va corresponding to the reference current CREF, which is larger than the zero current Izero. Accordingly, in the present invention, the node NO_E storing the second sampled value Va having a lower potential is grounded for removing common noise components (④ of FIG. 13). By capacitor coupling, the potential of the node NO_O of the sampling & differential capacitor CS is decreased by an amount equal to the second sampled value Va. Next, in the first sensing operation, the first holding switch HOLD_O is turned on to supply the voltage Vb-Va at the node NO_O, from which the noise components are removed, as an output Vout to the ADC.

In the second sensing operation, the reset switch RST of the sensing unit UNIT#n is simultaneously turned on to allow the current integrators of the sensing unit UNIT#n to operate as a unit gain buffer and bias the reference current CREF with noise components to the odd sensing channel CH_O of the sensing unit UNIT#n. Since the reference current CREF is not applied to the even sensing channel CH_E of the sensing unit UNIT#n, a zero current Izero—which is much lower than the reference current—caused by the noise components flows to the even sensing channel CH_E of the sensing unit UNIT#n (②' of FIG. 13). Next, in the second sensing operation, the reset switch RST of the sensing unit UNIT#n is turned off to allow the current integrators of the sensing unit UNIT#n in an integration mode. In the integration mode, the output of the first current integrator connected to the odd sensing channel CH_O is stored as a first sampled value Vb at the other node NO_O of the sampling & differential capacitor CS, and the output of the second current integrator connected to the even sensing channel CH_E is stored as a second sampled value Va at one node NO_E of the sampling & differential capacitor CS (③' of FIG. 13). Next, in the second sensing operation, the second noise cancelling switch HOLD_EG is turned on to connect the node NO_O of the sampling & differential capacitor CS to the ground power source and remove common noise components from the first and second sampled values Vb and Va. Next, in the present invention, the node NO_O storing the first sampled value Vb having a lower potential is grounded for removing common noise components (④' of FIG. 13). By capacitor coupling, the potential of the node NO_E of the sampling & differential capacitor CS is decreased by an amount equal to the first sampled value Vb. Next, in the second sensing operation, the second holding switch HOLD_E is turned on to supply the voltage Va-Vb at the node NO_E, from which the noise components are removed, as an output Vout to the ADC.

The present invention compensates for offset errors in the current integrators and/or gain errors in the current integrators based on digital sensed values obtained by CI calibration.

Sensing Mode

Figure 14:
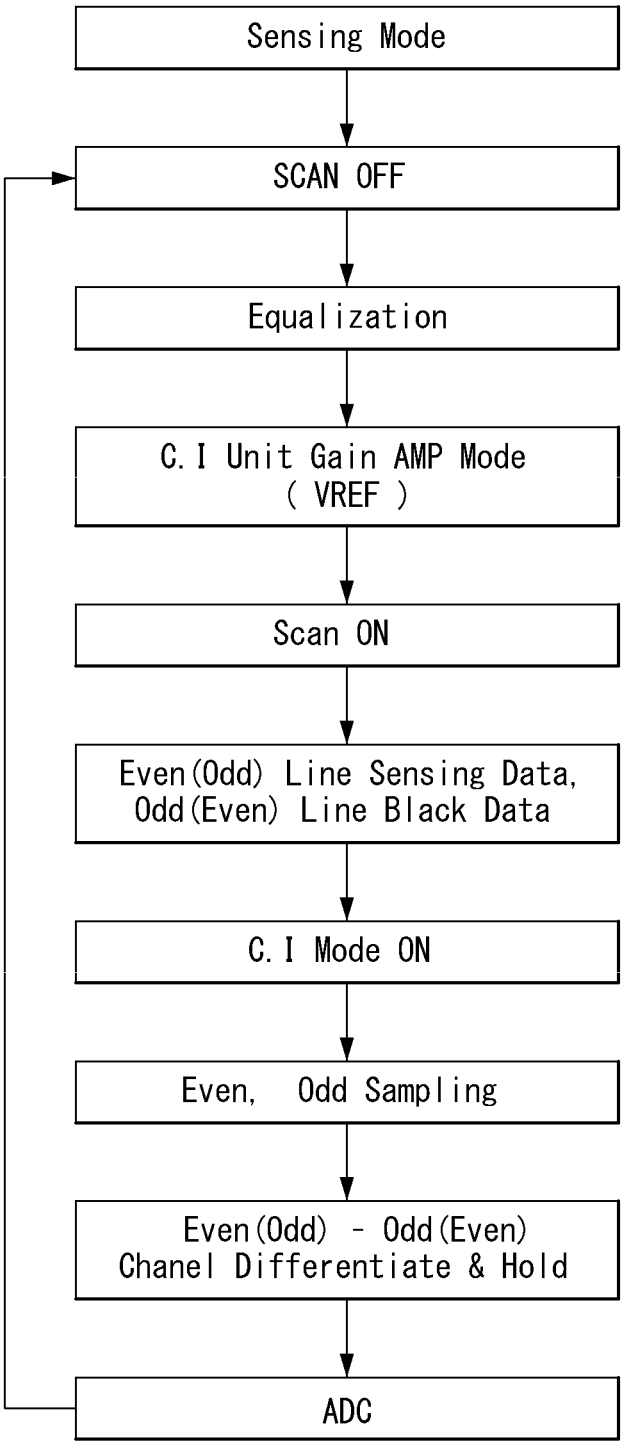
FIG. 14 schematically shows the operational sequence of the sensing mode.
Figure 15:
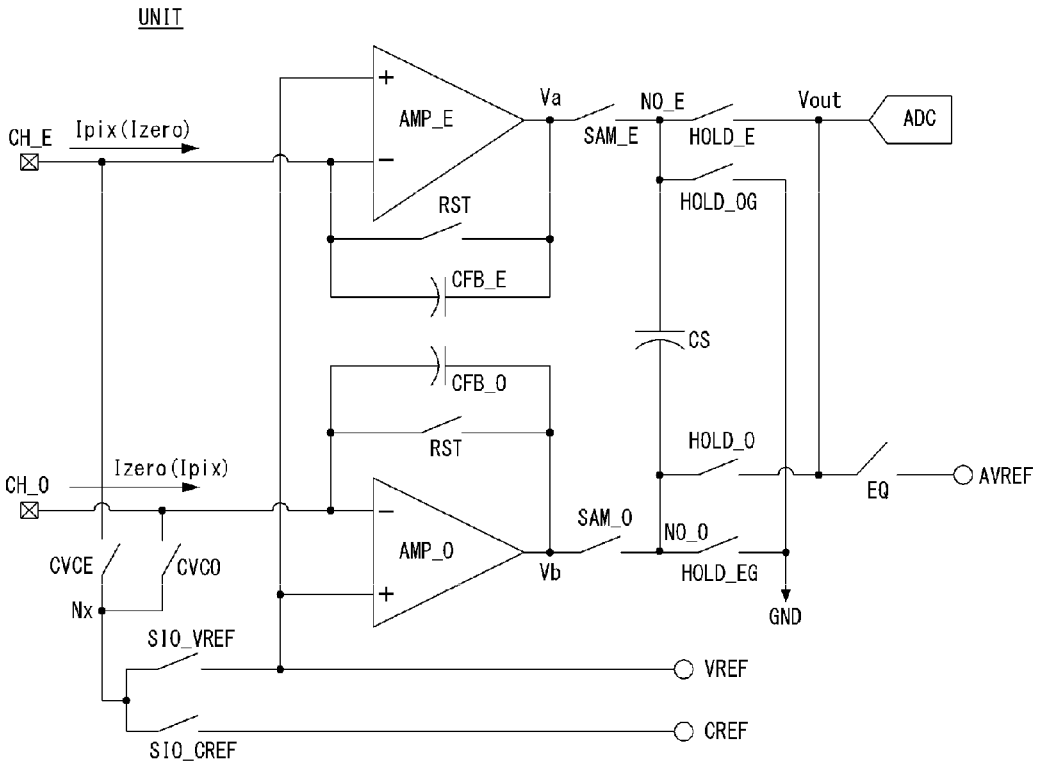
FIGS. 15 and 16 show an operating state of a sensing unit in the sensing mode.
Figure 16:
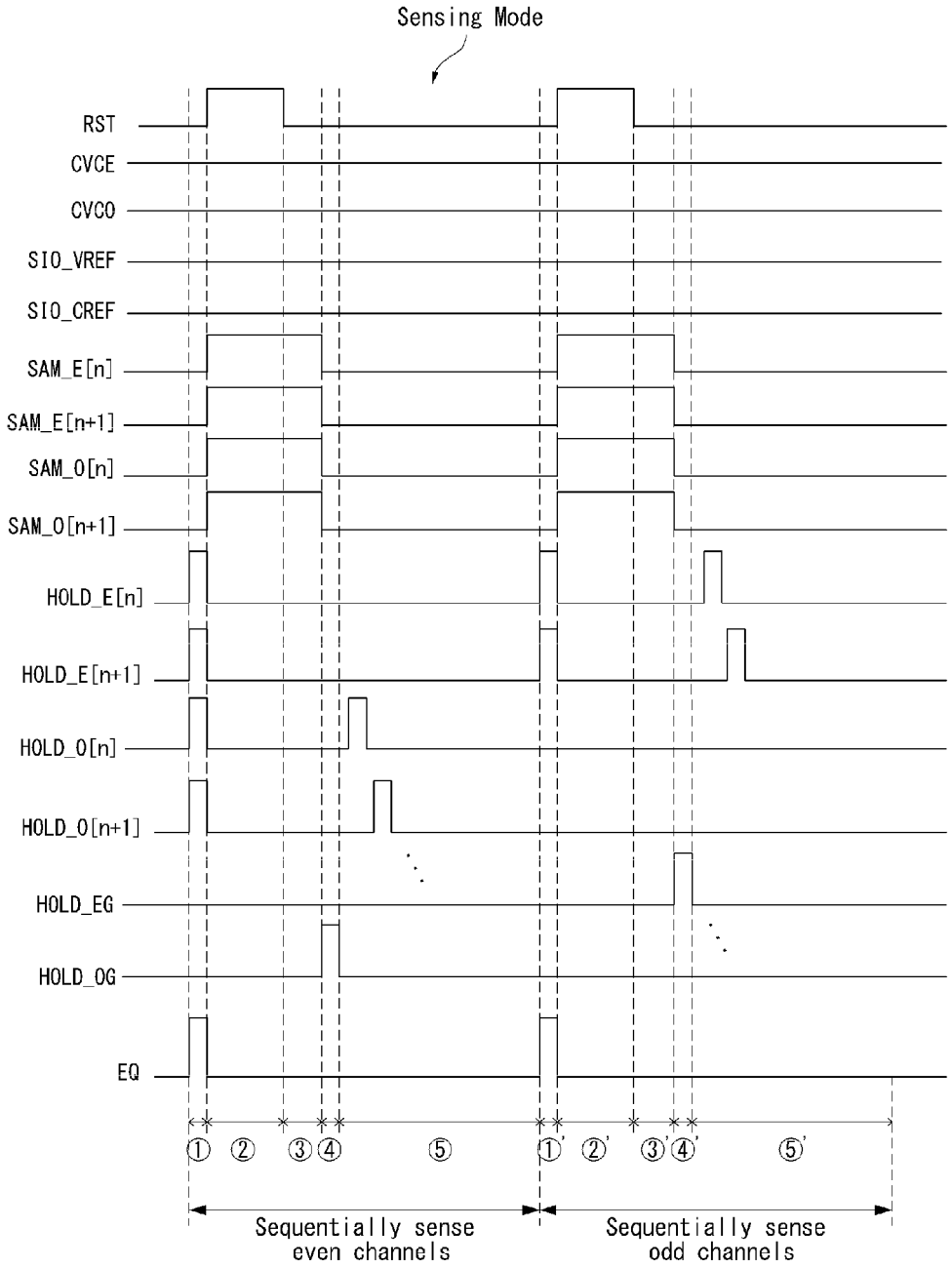
Figure 17:
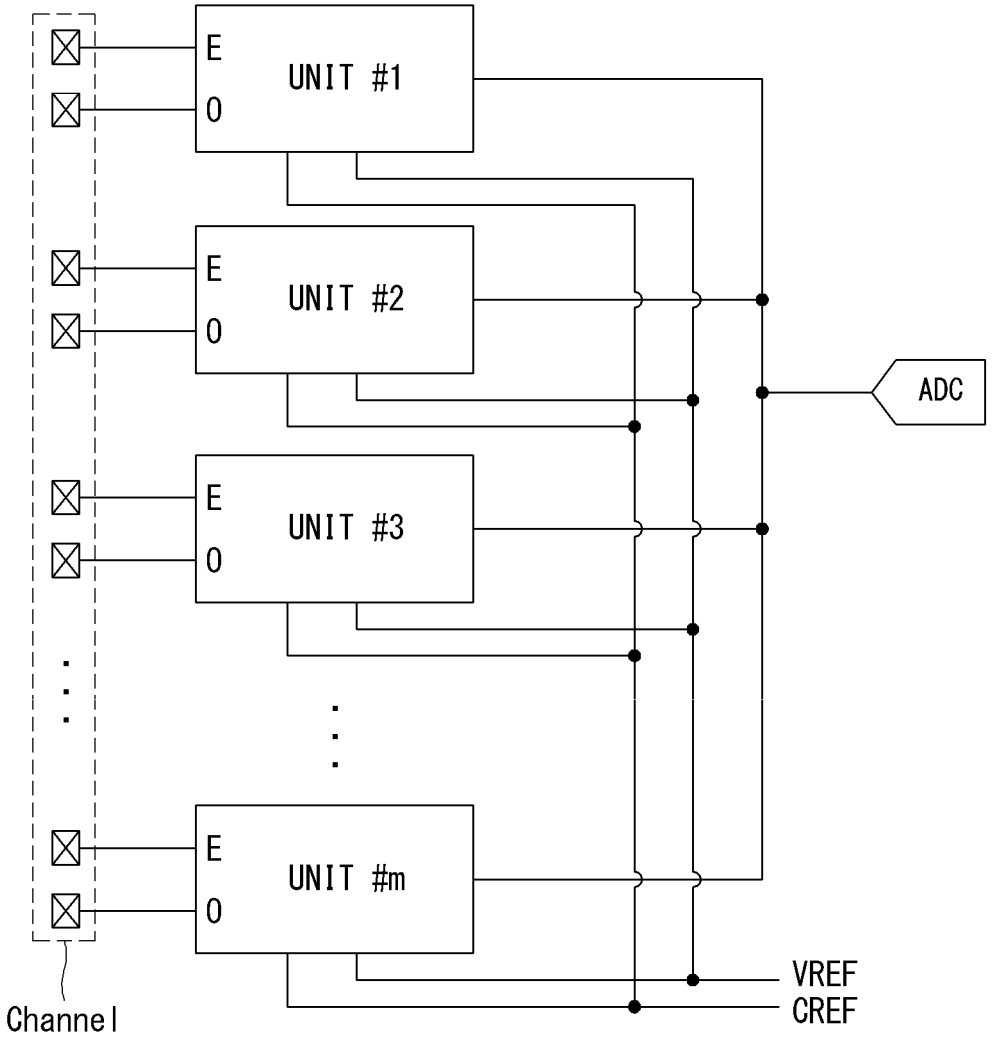
FIG. 17 is a view showing a reference current and a reference voltage being commonly applied to the sensing units.

FIG. 14 schematically shows the operational sequence of the sensing mode. FIGS. 15 and 16 show an operating state of a sensing unit in the sensing mode.

Referring to FIGS. 14 to 16, the sensing mode allows the display panel to be driven, and is performed based on pixel current data received from the display panel. The sensing mode is performed in two periods comprising: an odd sensing period for sensing pixel currents input from the odd sensing lines and sequentially outputting them; and an even sensing period for sensing pixel currents input from the even sensing lines and sequentially outputting them. Here, the sensing data voltage comprises a data voltage for a given grayscale that generates a pixel current greater than 0 and a data voltage for a black gray scale that generates no pixel current.

In the odd sensing period, the data voltage for a given grayscale is applied simultaneously to the pixels connected to the odd sensing lines through the data lines, and the data voltage for a black grayscale is applied simultaneously to the pixels connected to the even sensing lines through the data lines. On the other hand, in the even sensing period, the data voltage for a given grayscale is applied simultaneously to the pixels connected to the even sensing lines through the data lines, and the data voltage for a black grayscale is applied simultaneously to the pixels connected to the odd sensing lines through the data lines.

In the sensing mode, the even sensing channels may be sensed firstly during the even sensing period and then the odd sensing channels may be sensed secondly during the odd sensing period, or vice versa. In FIG. 16, [n] indicates an nth sensing unit UNIT#n, and [n+1] indicates an (n+1)th sensing unit UNIT#n+1.

In the even sensing period, the first and second holding switches HOLD_O and HOLD_E and equalization switches EQ of the sensing units UNIT#1 to UNIT#m are simultaneously turned on to equalize both ends of the sampling & differential capacitor CS (① of FIG. 16). Subsequently, in the even sensing period, the reset switches RST of the sensing units UNIT#1 to UNIT#m are turned on to allow the current integrators of the sensing units UNIT#1 to UNIT#m to operate as unit gain buffers. In this case, a pixel current Ipix with noise components is applied to the even sensing channels CH_E of the sensing units UNIT#1 to UNIT#m, whereas a zero current Izero caused by the noise components is applied to the odd sensing channels CH_O of the sensing units UNIT#1 to UNIT#m (② of FIG. 16). Next, in the even sensing period, the reset switches RST of the sensing units UNIT#1 to UNIT#m are turned off to allow the current integrators of the sensing units UNIT#1 to UNIT#m in an integration mode. In the integration mode, the output of the second current integrators connected to the even sensing channels CH_E is stored as a second sampled value Va at one node NO_E of each sampling & differential capacitor CS, and the output of the first current integrators connected to the odd sensing channels CH_O is stored as a first sampled value Vb at the other node NO_O of each sampling & differential capacitor CS (③ of FIG. 16). Next, in the even sensing period, the first noise cancelling switches HOLD_OG are turned on to connect the nodes NO_E of the sampling & differential capacitors CS to the ground power source and remove common noise components from the first and second sampled values Vb and Va. In the present invention, the nodes NO_E storing the second sampled value Va having a lower potential is grounded for removing common noise components (④ of FIG. 16). By capacitor coupling, the potential of the nodes NO_O of the sampling & differential capacitors CS are decreased by an amount equal to the second sampled value Va. Next, in the even sensing period, the first holding switches HOLD_O of the sensing units UNIT#1 to UNIT#m are sequentially turned on to sequentially supply the voltage Vb-Va at the nodes NO_O of the sampling & differential capacitors CS, from which the noise components are removed, as an output Vout to the ADC.

In the odd sensing period, the first and second holding switches HOLD_O and HOLD_E and equalization switches EQ of the sensing units UNIT#1 to UNIT#m are simultaneously turned on to equalize both ends of the sampling & differential capacitor CS (①' of FIG. 16). Subsequently, in the odd sensing period, the reset switches RST of the sensing units UNIT#1 to UNIT#m are turned on to allow the current integrators of the sensing units UNIT#1 to UNIT#m to operate as unit gain buffers. In this case, a pixel current Ipix with noise components is applied to the odd sensing channels CH_O of the sensing units UNIT#1 to UNIT#m, whereas a zero current Izero caused by the noise components is applied to the even sensing channels CH_E of the sensing units UNIT#1 to UNIT#m (②' of FIG. 16). Next, in the odd sensing period, the reset switches RST of the sensing units UNIT#1 to UNIT#m are turned off to allow the current integrators of the sensing units UNIT#1 to UNIT#m in an integration mode. In the integration mode, the output of the first current integrators connected to the odd sensing channels CH_O is stored as a first sampled value Vb at the other node NO_O of each sampling & differential capacitor CS, and the output of the second current integrators connected to the even sensing channels CH_E is stored as a second sampled value Va at one node NO_E of each sampling & differential capacitor CS (③' of FIG. 16). Next, in the odd sensing period, the second noise cancelling switches HOLD_EG are turned on to connect the nodes NO_O of the sampling & differential capacitors CS to the ground power source and remove common noise components contained in the first and second sampled values Vb and Va. In the present invention, the nodes NO_O storing the first sampled value Vb having a lower potential is grounded for removing common noise components (④' of FIG. 16). By capacitor coupling, the potential of the nodes NO_E of the sampling & differential capacitors CS are decreased by an amount equal to the first sampled value Vb. Next, in the odd sensing period, the second holding switches HOLD_E of the sensing units UNIT#1 to UNIT#m are sequentially turned on to sequentially supply the voltage Va-Vb at the nodes NO_E of the sampling & differential capacitors CS, from which the noise components are removed, as an output Vout to the ADC.

Figure 18:
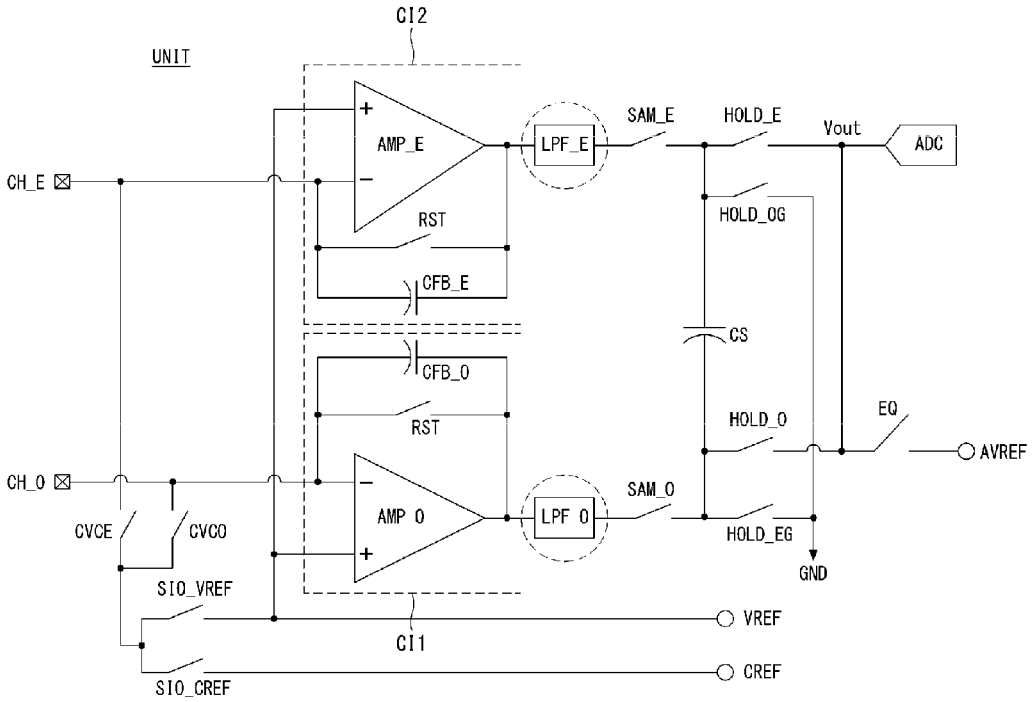
FIG. 18 shows a modification of a sensing unit according to the present invention.

FIG. 18 shows a modification of a sensing unit according to the present invention.

Referring to FIG. 18, in addition to the components shown in FIG. 7, each of the sensing units UNIT#1 to UNIT#m may further comprise a first low-pass filter LPF_O connected between the output terminal of the first current integrator CI1 and the first sampling switch SAM_O and a second low-pass filter LPF_E connected between the output terminal of the second current integrator CI2 and the second sampling switch SAM_E. The first and second low-pass filters LPF_O and LPF_E may be implemented as well-known filter circuits each comprising a resistor and a capacitor.

The first low-pass filter LPF_O firstly filters out noise components from the output of the first current integrator CI1 before the output of the first current integrator CI1 is stored in the sampling & differential capacitor CS.

Likewise, the second low-pass filter LP firstly filters out noise components from the output of the second current integrator CI2 before the output of the second current integrator CI2 is stored in the sampling & differential capacitor CS.

The present invention can maximize the noise component cancelling effect by filtering out noise components from the output of the first and second current integrators CI1 and CI2 in advance through the first and second low-pass filters LPF_O and LPF_E.

Figure 19:
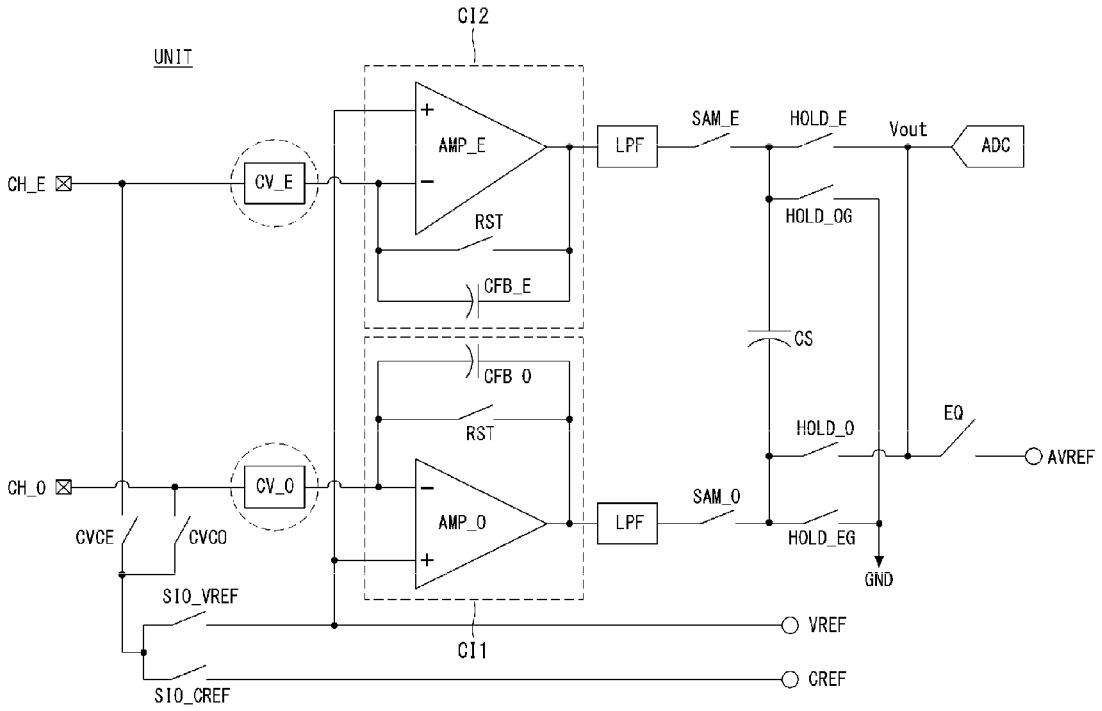
FIG. 19 shows another modification of a sensing unit according to the present invention.

FIG. 19 shows another modification of a sensing unit according to the present invention.

Referring to FIG. 19, in addition to the components shown in FIG. 18, each of the sensing units UNIT#1 to UNIT#m may further comprise a first current conveyor CV_O connected between an odd sensing channel CH_O and a first current integrator CI1 and a second current conveyor CV_E connected between an even sensing channel CH_E and a second current integrator CI2. The first and second current integrators CV_O and CV_E may be implemented as well-known current conveyor circuits each comprising a plurality of transistors and resistors.

The first current conveyor CC_O serves to prevent pixel current leakage caused by impedance matching, etc., and transmit the pixel current of the odd sensing channel CH_O to the first current integrator with minimum loss.

Likewise, the second current conveyor CC_E serves to prevent pixel current leakage caused by impedance matching, etc., and transmit the pixel current of the even sensing channel CH_E to the second current integrator with minimum loss.

Reducing pixel current loss by the first and second current conveyors CV_O and CV_E leads to a significant improvement in sensing accuracy.

Figure 20:
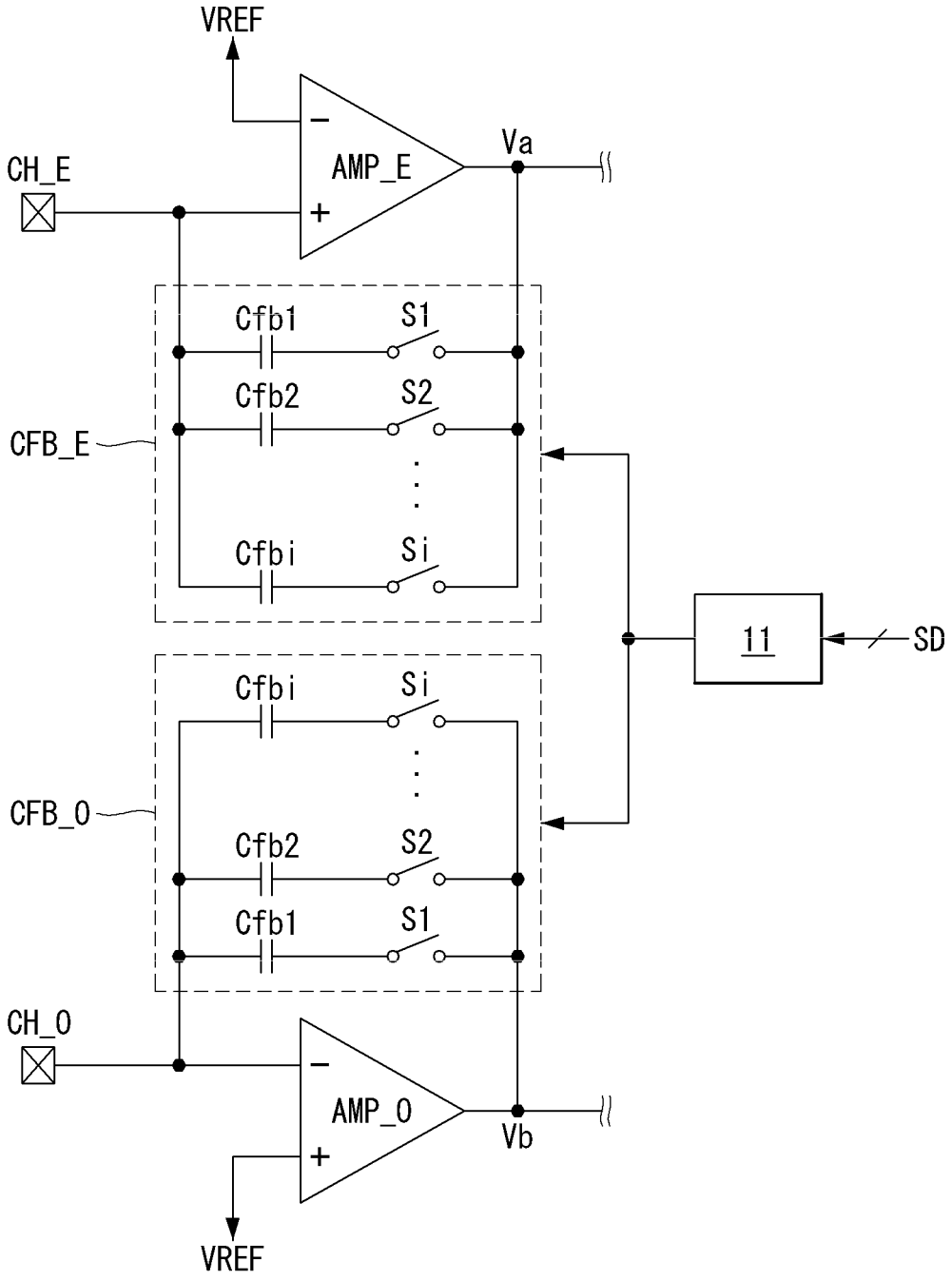
FIG. 20 shows a method for adjusting the capacitance of integration capacitors to prevent ADC over-range.

FIG. 20 shows a method for adjusting the capacitance of integration capacitors to prevent ADC over-range.

An ADC is a special encoder which converts an analog signal into data in the form of a digital signal. The ADC has a fixed input voltage range, i.e., fixed sensing range. Although the voltage range of the ADC may differ depending on the resolution of AD conversion, it is usually set to Evref (ADC reference voltage) to Evref+3V (k is a positive real number). The resolution of AD conversion is the number of bits that are used to convert an analog input voltage into a digital value. If an analog signal input into the ADC is out of the input range of the ADC, underflow occurs where the ADC's output is smaller than the smallest value of the input voltage range, or overflow occurs where the ADC's output is larger than the largest value of the input voltage range.

When such ADC over-range occurs, sensing accuracy is lowered. To prevent ADC over-range, the present invention suggests a method for adjusting the integration capacitance of the first and second current integrators CI1 and CI2 included in the sensing unit according to a digital sensed value output from the ADC.

To this end, in the present invention, the first and second integration capacitors CFB_O and CFB_E of FIG. 7 may be designed as shown in FIG. 20. Referring to FIG. 20, each of the first and second integration capacitors CFB_O and CFB_E may comprise a plurality of capacitors Cfb1 to Cfbi connected in parallel to the inverting input terminal (−) of the amplifier AMP_O or AMP_E and a plurality of capacitance adjustment switches S1 to Si connected between the capacitors Cfb1 to Cfbi and the output terminal of the amplifier AMP_O or AMP_E. The coupling capacitance of each of the first and second integration capacitor CFB_O and CFB_E is determined depending on the number of turned-on capacitance adjustment switches S1 to Si.

The timing controller 11 analyzes digital sensed values SD, and generates a different switching control signal according to the ratio of digital sensed values SD equal to predetermined smallest and largest values from the ADC among all the digital sensed values. The capacitance adjustment switches S1 to Si are turned on/off in response to the switching control signal from the timing controller 11. The larger the coupling capacitance of the integration capacitor CFB_O or CFB_E, the gentler the falling slope of an output Vout of the current integrator CI1 or CI2. On the contrary, the smaller the coupling capacitance of the integration capacitor CFB_O or CFB_E, the steeper the falling slope of an output Vout of the current integrator CI1 or CI2.

Accordingly, the timing controller 11 controls the number of capacitance adjustment switches S1 to Si turned on by the switching control signal to increase the coupling capacitance of each of the first and second integration capacitors CFB_O and CFB_E if underflow occurs where the ADC's output is smaller than the smallest value of the input voltage range and on the contrary decrease the coupling capacitance of each of the first and second integration capacitors CFBO and CFB_E if overflow occurs where the ADC's output is larger than the largest value of the input voltage range.

As described above in detail, the present invention can greatly reduce the sensing time required to sense variations in electrical characteristics of a driving element by implementing low-current sensing and high-speed sensing by a current sensing method using a current integrator. Moreover, the present invention can greatly increase sensing accuracy by performing multi-time sensing on each pixel within one line sensing ON time.

Moreover, each sensing unit comprises a first current integrator connected to an odd sensing channel, a second current integrator connected to an even sensing channel neighboring the odd sensing channel, and a sample & hold unit that removes common noise components from a first sampled value input from the first current integrator and a second sampled value input from the second current integrator while storing and holding the first and second sampled values.

With this configuration, the present invention can minimize the effect of noise entering the current integrators caused by different sources of noise between the sensing lines and sense pixel current more accurately, thereby greatly improving sensing performance and even compensation performance.

From the foregoing description, those skilled in the art will readily appreciate that various changes and modifications can be made without departing from the technical idea of the present invention. Therefore, the technical scope of the present invention is not limited to the contents described in the detailed description of the specification but defined by the appended claims.

What is claimed:

1. An organic light emitting display comprising:

a display panel with a plurality of pixels connected to data lines and sensing lines, each pixel comprising an OLED and a driving TFT for controlling the amount of light emission of the OLED; and a data driver IC comprising a DAC for applying a sensing data voltage to the data lines, a plurality of sensing units for sensing current data of the pixels through a plurality of sensing channels connected to the sensing lines, and an ADC commonly connected to the sensing units, each sensing unit comprising:

a first current integrator connected to an odd sensing channel;

a second current integrator connected to an even sensing channel neighboring the odd sensing channel; and a sample & hold unit that removes common noise components from a first sampled value input from the first current integrator and a second sampled value input from the second current integrator while storing and holding the first and second sampled values.

2. The organic light emitting display of claim 1, wherein the sample & hold unit comprises:

a sampling & differential capacitor connected between a first output node of the first current integrator and a second output node of the second current integrator;

a first sampling switch connected between the output terminal of the first current integrator and the first output node;

a second sampling switch connected between the output terminal of the second current integrator and the second output node;

a first holding switch connected between the first output node and the input terminal of the ADC;

a second holding switch connected between the second output node and the input terminal of the ADC;

a first noise cancelling switch connected between the second output node and a ground power source; and a second noise cancelling switch connected between the first output node and the ground power source.

3. The organic light emitting display of claim 1, wherein a sensing operation is performed in two periods comprising: an odd sensing period for sensing pixel currents input from the odd sensing lines and sequentially outputting the same; and an even sensing period for sensing pixel currents input from the even sensing lines and sequentially outputting the same, the pixel currents indicate source-drain currents flowing through the driving TFTs of the pixels, and the sensing data voltage comprises a data voltage for a given grayscale that generates a pixel current greater than 0 and a data voltage for a black gray scale that generates no pixel current, wherein, in the odd sensing period, the data voltage for a given grayscale is applied simultaneously to the pixels connected to the odd sensing lines through the data lines, and the data voltage for a black grayscale is applied simultaneously to the pixels connected to the even sensing lines through the data lines, and in the even sensing period, the data voltage for a given grayscale is applied simultaneously to the pixels connected to the even sensing lines through the data lines, and the data voltage for a black grayscale is applied simultaneously to the pixels connected to the odd sensing lines through the data lines.

4. The organic light emitting display of claim 3, wherein, in the odd sensing period, the first sampled value contains both pixel current components and the common noise components and the second sampled value contains only the common noise components, and in the even sensing period, the second sampled value contains both pixel current components and the common noise components and the first sampled value contains only the common noise components.

5. The organic light emitting display of claim 1, wherein each of the sensing units further comprises a calibration switching unit for compensating for variations in the ADC's characteristics and variations in the characteristics of the first and second current integrator, the calibration switching unit comprising:

a first biasing switch connected between a node X and an odd sensing channel;

a second biasing switch connected between the node X and an even sensing channel;

a voltage sourcing switch connected between the node X and the input terminal of a reference voltage; and a current sourcing switch connected between the node X and the input terminal of a reference current.

6. The organic light emitting display of claim 2, wherein each of the sensing units further comprises an equalization switch connected between the input terminal of an equalization voltage and the input terminal of the ADC, wherein the first and second holding switches and the equalization switch are simultaneously turned on for a predetermined period of time during the sensing operation to equalize both ends of the sampling & differential capacitor.

7. The organic light emitting display of claim 2, wherein each of the sensing units further comprises:

a first low-pass filter connected between the output terminal of the first current integrator and the first sampling switch; and a second low-pass filter connected between the output terminal of the second current integrator and the second sampling switch.

8. The organic light emitting display of claim 1, wherein each of the sensing units further comprises:

a first current conveyor connected between an odd sensing channel; and a first current integrator and a second current conveyor connected between an even sensing channel and a second current integrator.

9. The organic light emitting display of claim 1, wherein each of the first and second current integrator comprises:

an amplifier comprising an inverting input terminal connected to any one of the sensing channels, a non-inverting input terminal for receiving a reference voltage, and an output terminal for outputting sampled values;

an integration capacitor connected between the inverting input terminal and output terminal of the amplifier; and a first switch connected to both ends of the integration capacitor, each of the first and second integration capacitors comprising:

a plurality of capacitors connected in parallel to the inverting input terminal of the amplifier; and a plurality of capacitance adjustment switches connected between the capacitors and the output terminal of the amplifier, the capacitance adjustment switches are turned on/off in response to a switching control signal from based on a digital sensed value output from the ADC.

* * * * *